US005685112A

United States Patent [19]

Fara

[11] Patent Number: 5,685,112

[45] **Date of Patent: *Nov. 11, 1997**

[54] APPARATUS AND METHOD FOR REMOVING STRUCTURAL PARTS OF A BUILDING WITHOUT CONTAMINATING ADJACENT AREAS

[76] Inventor: Mark C. Fara, 11803 Browningsville Rd., Monrovia, Md. 21770

[ * ] Notice: The term of this patent shall not extend beyond the expiration date of Pat. No. 5,457,922.

[21] Appl. No.: 542,172

[22] Filed: Oct. 12, 1995

Related U.S. Application Data

[63] Continuation-in-part of Ser. No. 314,942, Sep. 29, 1994, Pat. No. 5,457,922.

[51] Int. Cl.[6] ..... E04G 21/24

[52] U.S. Cl. ..... 52/202; 52/DIG. 12; 52/127.2; 52/745.15; 312/1; 312/245

[58] Field of Search ..... 52/DIG. 12, 202, 52/514, 127.1, 127.2, 745.15, 745.16, 126.1, 126.3, DIG. 17; 248/161, 354.11, 244; 312/245, 247, 1; 49/61

[56] References Cited

U.S. PATENT DOCUMENTS

| | | | |
|---|---|---|---|
| 590,602 | 9/1897 | Thompson . | |
| 2,531,251 | 11/1950 | Bruno . | |
| 2,741,410 | 4/1956 | Violette | 312/1 X |
| 3,184,982 | 5/1965 | Auer . | |
| 3,323,851 | 6/1967 | Duboff | 312/247 |
| 3,583,743 | 6/1971 | Newell | 248/354.1 X |
| 3,593,474 | 7/1971 | Neels | 52/311.3 X |
| 4,193,232 | 3/1980 | Almsted et al. . | |
| 4,221,091 | 9/1980 | Ganse et al. . | |
| 4,304,078 | 12/1981 | Meriwether, Jr. | 248/354.3 X |
| 4,809,391 | 3/1989 | Soldatovic | 312/1 X |
| 4,911,191 | 3/1990 | Bain | 312/1 X |
| 5,012,537 | 5/1991 | Underwood | 312/1 X |
| 5,062,871 | 11/1991 | Lemon, III | 312/1 X |
| 5,088,511 | 2/1992 | Bain | 312/1 X |
| 5,201,152 | 4/1993 | Heffner . | |
| 5,249,397 | 10/1993 | Monaco | 52/126.1 |
| 5,457,922 | 10/1995 | Fara | 52/202 |

FOREIGN PATENT DOCUMENTS

| | | | |
|---|---|---|---|
| 2411282 | 8/1979 | France | 52/DIG. 12 |
| 2751219 | 5/1979 | Germany | 52/DIG. 12 |
| 3004066 | 8/1981 | Germany | 312/1 |
| 10833 | of 1891 | United Kingdom | 248/161 |
| 2260559 | 4/1993 | United Kingdom | 248/354.1 |

OTHER PUBLICATIONS

"How Things Work III" pp. 210–213, 225–226 and 228–229.

*Primary Examiner*—Carl D. Friedman
*Assistant Examiner*—Laura A. Saladino
*Attorney, Agent, or Firm*—Leonard Bloom

[57] ABSTRACT

The invention is directed to a pollution abatement apparatus for use during a polluted window frame (or other polluted structures) removal in order to prevent toxic material from entering the inhabited areas of the building. The apparatus includes a rigid unitary member adapted to fit against the polluted structure within the interior of the building and to surround the polluted structure in an air-tight manner as the polluted structure is being removed from outside of the building. The rigid unitary member is capable of being height adjusted and clamped between the floor and the ceiling after the "rough" and "fine" height adjustments have been made.

45 Claims, 22 Drawing Sheets

APPARATUS AND METHOD FOR REMOVING STRUCTURAL PARTS OF A BUILDING WITHOUT CONTAMINATING ADJACENT AREAS

CROSS REFERENCE TO RELATED APPLICATION

The parent application is a continuation-in-part of application Ser. No. 08/314,942 filed Sep. 29, 1994 for APPARATUS AND METHOD OF REMOVING STRUCTURAL PARTS OF A BUILDING WITHOUT CONTAMINATING ADJACENT AREAS (issued on Oct. 17, 1995 as U.S. Pat. No. 5,457,922) the disclosure of which is incorporated herein in its entirety.

STATEMENT REGARDING FEDERALLY SPONSORED RESEARCH OR DEVELOPMENT (Not applicable.)

REFERENCE TO A MICROFICHE APPENDIX SPECIFYING THE TOTAL NUMBER OF MICROFICHE AND TOTAL NUMBER OF FRAMES (Not applicable.)

BACKGROUND OF THE INVENTION

The invention relates to apparatus and methods used to remove structural parts of a building without contaminating the area surrounding the building or the inhabited living areas of the building.

There is a need in the art for structurally modifying inhabited building structures without substantial inconvenience and disruption to the normal activity of the residents of the building.

In recent years the public has been made aware of toxicity to our environment. For example, air pollution by automobile exhaust gases and industrial emissions; polluted lakes and streams due to water run-off carrying fertilizers, insecticides and strip-mined coal residue; and pollution in the home due to lead and asbestos, are all pollutants well known to the ordinary citizen. Infants and young children are most at risk due to lead exposure. Lead exposure can seriously injure the child's brain and nervous system.

Lead based paint pollution is a major public hazard. The hazardousness of lead based paint has been recognized by the U.S. Government. The Department of Housing and Urban Development has issued guidelines for dealing with lead-based paint hazard identification and abatement in public housing.

The federal government has mandated lead abatement in public housing project modernization. Before undertaking such abatement projects, personnel are to be trained as to aspects of safety. Procedures are to be instituted to minimize lead pollution affecting both the workers and the environment. The need to wear protective clothing is a must, e.g., gloves, masks, eye protection, etc.

When removing lead-contaminated structures, measures for controlling debris and lead dust must be instituted. The work area must be enclosed and toxic material disposed of with care. Workers must wear properly fitted respirators. Protective clothing, such as, protective overalls, disposable shoe covers, gloves, hats and goggles must be worn at all times. Care must be taken to effectively dispose of contaminated work clothing. Workers must shower to remove residual lead dust contamination.

All movable furniture, draperies should be moved out of the work area. If carpeting is to be left in place, it must be covered with two sheets of 6 mil polyethylene sheeting secured to the walls or baseboard with masking tape. Furniture left in the work area must be covered with plastic and sealed with tape. In some instances an entire area of a room is to be sealed off with tape and polyethylene sheeting running from wall to wall and floor to ceiling. All tears in plastic must be immediately repaired.

As can be seen from the above exposition of facts, the removal of lead contamination from existing building structures is no easy task.

Prior art U.S. Patents show the state of the art.

Almstead et al in U.S. Pat. No. 4,193,232 discloses a window cap for sealing a window to conserve energy. The device is pan-like with edges which can be attached to the building structure to keep cold air from entering the building through the windows.

U.S. Pat. No. 4,221,091 to Ganse et al discloses an insulation system for windows with the insulation panels placed in brackets on the inside walls.

A containment device for contaminated building demolition is taught by Heffner in U.S. Pat. No. 5, 201,152. The Heffner containment device is designed to surround an entire building. The device is made of a rigid steel frame, covered with a flexible fabric or plastic sheet material, and moves on railroad tracks from place to place.

None of the prior art containment devices describe a containment box surrounding a work area, attached to the floor and ceiling of a room and having a seal between the containment box and wall to prevent contamination of inhabited areas during building structure modification.

BRIEF SUMMARY OF THE INVENTION

The invention herein disclosed addresses the problem of pollution and inconvenience to residents of homes and offices being remodeled. The invention is particularly concerned with the removal of lead contaminated windows and window frames in occupied buildings. Lead contaminated window frame removal presents an environmental problem, not only due to lead which might pollute the environment, but also due to dust pollution.

The present commercial method used by environmental contractors is to build an enclosure out of 6 mil. poly film. This enclosure is about 6' away from the wall where the window (or windows) are located and provides an enclosure for the personnel who are removing the window and its frame. The poly film enclosure prevents also dust and debris from entering living areas. It goes without saying that this method is inefficient because of the length of time that it takes to make such an enclosure. Moreover, the plastic or poly film is subject to tearing or cutting and would require repair. To seal the enclosure against the wall, tape or a like material has to be used, which when removed from the wall leaves destructive marks on the paint or wall paper.

If the floor is carpeted, the carpet must be covered with plastic and sealed down by tape. Sealing with tape is difficult because the tape does not always effectively seal the carpet and furthermore, the tape seal could ruin the carpet. If the tape itself does not stick then a special spray glue has to be used, adding further to inconvenience. Finally, the poly film itself becomes contaminated and must be handled as a hazardous material and brought to a suitable landfill along with the removed window and its frame for disposal.

The heart of this invention is a containment box which facilitates the making of structural modifications to buildings and is particularly useful in expediting the removal of windows and window frames of existing buildings in an environmentally safe manner. The building living area can remain occupied while modifications are being made. Windows and frames of existing buildings must be removed, bearing in mind that they can be contaminated with several coatings of lead-based paint. In many instances there are so many coatings of lead paint on the windows that the windows have been painted shut.

The invention herein disclosed completely reverses the methodology employed by the prior art. Rather than working from inside the building to remove the contaminated window frame, the worker employing the methodology and containment box of this invention works from the outside.

To facilitate working from the outside, a containment box is placed on the inside wall surrounding the window or frame to be removed. This containment box is made of non-porous panels or tile boards (similar to those used in kitchens and baths) and the panels are completely sealed and closed so as to be substantially completely airtight. A gasket of foam or other suitable material is utilized around the periphery of the box to provide an airtight seal against the wall to accommodate any variations in the wall thickness or surface texture.

The containment box is provided with a jackscrew at its bottom to engage the floor and a brace at the top to engage the ceiling. The jackscrew cooperates with a floor pad; and the ceiling brace cooperates with a ceiling pad. The jackscrew works similarly to a turnbuckle; and using a ratchet wrench, one can quickly install the containment box. As a modification the ceiling brace can be replaced with a jackscrew such that adjustment is made by adjusting either jackscrew. While it is possible to place the jackscrew either at the top or bottom of the box, it is more convenient that the jackscrew be placed at the bottom of the box because no latter or step-stool would be required to reach the jackscrew. In certain types of windows the containment box could sit on the floor and could be fixed to the ceiling by a jackscrew set on top of the box to brace against the ceiling. For added support an angled brace could be supplied to the back of the box to support the box against the wall. The brace could be simply kicked into place to further anchor the box against the wall. As alternative embodiments, the brace could be hinged to the back of the box, or could be telescopic.

In yet another alternative embodiment, the apparatus of the present invention preventing a pollutant from entering the building during the polluted structure (a window or a door) removal, comprises a single unitary member, which is a molded plastic rigid integral unit (containment member), preferably transparent, for being placed on a required height against the wall to surround the polluted structure.

A handle means are carried by the plastic unit for lifting and positioning the latter against the window (or the door). Ratchet-actuated clamping means are associated with the handle means for rapidly clamping the plastic unit between the floor and the ceiling within the interior of the building.

"Rough" and "fine" height adjustment means are provided to adjust positioning of the plastic unit.

Preferably, the means for "rough" height adjustment includes at least one supporting member, along which the plastic unit reciprocally slides. The supporting member comprises a tubular body, a top edge pad for leaning against the ceiling and a bottom edge pad for leaning against the floor. The plastic unit is a rigid member having a bottom and walls extending from and continually surrounding the bottom of the plastic unit and having a ledge for leaning against the wall of the building and surrounding the polluted structure. Three metal bars cross the bottom of the plastic unit in spaced-apart arrangement and extend substantially a whole width of the plastic unit to stiffen the latter. Each bar, optionally, has a plurality of holes longitudinally spaced apart along each said bar.

Fastening means are removably secured to each of said bar for removably securing the supporting member to the plastic unit. Each fastening means includes a pair of resilient clips embracing the supporting member, such that the clipping of the supporting member is regulated from loosen to immovable by a weld nut, thereby allowing the "rough" height adjustment of the plastic unit.

Optionally, a pair of spaced-apart substantially parallel supporting members can be employed, each secured to respective edges of the three bars. Also, as an alternative, a single supporting member can be secured substantially to centers of the three bars, or diagonally to said plastic unit.

Semi-cylindrical spacers are positioned between the tubing body and respective resilient clips of the fastening means.

To accommodate the metal bars, the bottom of the plastic unit has respective crossing grooves extending the whole width of the plastic unit, such that each bar is secured within a respective crossing groove. A gasket is installed between each of said bars and the bottom of the plastic unit. Also, a gasket is provided on the ledge of the walls of the plastic unit to maintain the air-tight arrangement.

The supporting member has a telescoping top member, which is adjustably extended a certain length from a top end of the tubular body of the supporting member, thereby allowing a "fine" height adjustment for the plastic unit. The top edge pad is pivotally secured to a distal end of the telescopic top member. Preferably, a spring is installed beneath of the top edge pad to provide more flexibility in height adjustment. The supporting member also has a telescopic bottom member, which, being extended a certain length from a lower end of the tubular body of the supporting member, allows additional height adjustment for the plastic unit. The bottom edge pad is pivotally secured to a distal end of the telescopic bottom member. Preferably, both the top and the bottom edge pads are at least 4×4 square inches in a specific embodiment of the present invention.

The plastic units may be manufactured for different sizes and shapes of windows (or doors) and are provided with tags and/or logos.

Corners of the ledge of the plastic unit are rounded, and protective material is installed on the edge of the plastic unit to allow the latter to be slid during transportation and set up.

Preferably, the plastic unit is made from Lexan™, a polycarbonate material available from the General Electric Company, and has an opening in one of its walls for connection of a suction pump which would suck the air out of the Lexan™ unit in order to obtain a "negative air" within it, when it is set up and to provide even better sealing, and also for "cleaning" of the unit after the structure removal has been accomplished. A "sump" plate is attached to the unit to serve for connection of an inlet of the suction pump and for closing the connection opening once the suction pump is not needed.

Viewed in still another aspect, the present invention is an improvement to a method of removing a polluted structure from the wall in a building comprising the steps of providing a rigid containment means, removably installing the rigid containment means within the building, up against the inside of the wall, and surrounding the polluted structure in a substantially airtight manner, thereby confining any dust or debris within the rigid containment means and preventing inadvertent pollution within the building, removing the polluted structure, and removing the rigid containment means. Any dust or debris are removed from the interior of the rigid containment means before the later is removed, thereby facilitating subsequent re-use of the rigid containment means.

Once the containment unit is in place, the workman can remove the window and its frame from the outside. The window and its frame, along with the glass, are discarded in a dumpster which is taken to a landfill for hazardous material disposal. Any residue which falls into the containment unit is removed from the unit and discarded into the dumpster. The removal of the window frame is facilitated by the use of crow bars and pinch bars. Of course these bars, as well as other tools used in removal, must, from time to time, be decontaminated.

As an alternative to the use of the dumpster, a pick up truck with an enlarged tailgate or high-lift (snorkel lift) is brought flush up against the building beneath the window to collect the chips and debris that are generated when the window and its frame are removed. These chips and debris are then vacuumed up and the bed of the pick-up truck and tailgate are "de-toxed" using the trisodium phosphate spray and rag-disposal clean-up method.

In the cleanup operation, detergents with high-phosphate content (5% TSP) are most effective. These high phosphate detergents contain trisodium phosphate (TSP). The inside of the containment unit is cleaned using a detergent spray containing trisodium phosphate which has an affinity for lead. At times, a second spray may be required to ensure the complete removal of lead. After each spraying with trisodium phosphate, the spray is wiped off with a cloth or rag which has to be discarded along with the other toxic waste materials. Waste water from the cleanup is hazardous and should be treated accordingly.

Once the containment unit is cleaned and detoxified, it can be moved to another window and reused. (This is not possible with poly film as used in the prior art.) With proper maintenance the containment unit should have a long life.

The inventor in experiments has determined that the use of the containment box of this invention is much more efficient than the polyethylene plastic taping method. The containment unit method takes fifteen minutes to remove a window, while the taping method takes over an hour and involves additional cleanup and structural repair time.

While the containment unit has been described primarily in the context of removal of window frames it can be used to contain an area of the wall when part of the wall is to be removed. With modifications the containment box can be used where a door frame is to be replaced.

With slight modifications, the pollution abatement apparatus of the present invention can be used for removing a sky-light from the ceiling of the building. The pads of two supporting members will be then leaned against a pair of opposite walls within the building.

In a preferred embodiment of this invention a lead pollution containment unit for use in a room is placed against a wall to surround a window frame to prevent hazardous lead from entering the room during window frame removal. The containment box (or unit) comprises a container with sides having rear edges and front edges, the sides of the container being a top side, a bottom side, a left side and a right side, the sides having attached to their rear edge a back member to form a box, the front edge of the sides accommodate a gasket to provide a seal for said containment box. Said containment box when positioned against a wall to surround a window has attached to its bottom a vertical adjustable jack for floor support, and on its top side a brace as a ceiling support. The containment box when placed against a wall surrounding the window frame, with its gasket against the wall as a substantially airtight seal; and the adjustable jack for floor support tightened, such that the ceiling brace is securely fixed to the ceiling, the window frame can be removed in the surrounded area without contaminating the room.

The sides and back member of the containment box can be separate members and assembled to form the containment box; or the box can be an integral unit, such as made of molded plastic. As added support the containment box can be provided with an angled back brace attached to the back member to more securely fix the gasket to the wall.

A method is contemplated by this invention for removing a lead-polluted window frame from a building structure with minimum inconvenience and lead-pollution affecting the inhabitants of the building. The method comprising placing against the inside wall of the building and surrounding the window frame with a containment box. The containment box comprising a container with sides having rear edges and front edges, the sides of the container being a top side, a bottom side, a left side and a right side, with the sides having attached to their rear edge a back member to form a box. The front edge of the sides accommodate a gasket to provide a seal for said containment box. The box when positioned against a wall to surround said window frame has on its bottom side a vertical adjustable jack for floor support, and on its top side a brace as a ceiling support. The containment box being placed against said wall surrounding the window frame with the gasket against the wall to form a substantially airtight seal. The adjustable jack for floor support tightened such that the ceiling brace is securely fixed to the ceiling. Once the containment box is in place the lead polluted window frame in the surrounded area can be removed without contaminating the room. In specific application the lead polluted window frame is removed by a worker from the outside of the building structure.

In an embodiment of this invention a method is disclosed for removing a lead-paint polluted structure from the wall of a building, with the improvement comprising the steps of providing a containment means, removably installing the containment means within the building, up against the inside of the wall, and surrounding said lead-paint polluted structure in a substantially airtight manner, thereby confining any dust or debris within the containment means and preventing inadvertent pollution within the building, removing the lead-paint polluted structure while working from outside of the building, removing any dust or debris from the interior of the containment means, detoxifying the containment means, and removing the containment means for subsequent reuse thereof.

In the embodiment set forth above the lead polluted building structure can be for example, a window and window frame; or a door and door jamb. The containment means can be a containment box with a provided jackscrew for removably anchoring the containment box.

DESCRIPTION

Figure 1:
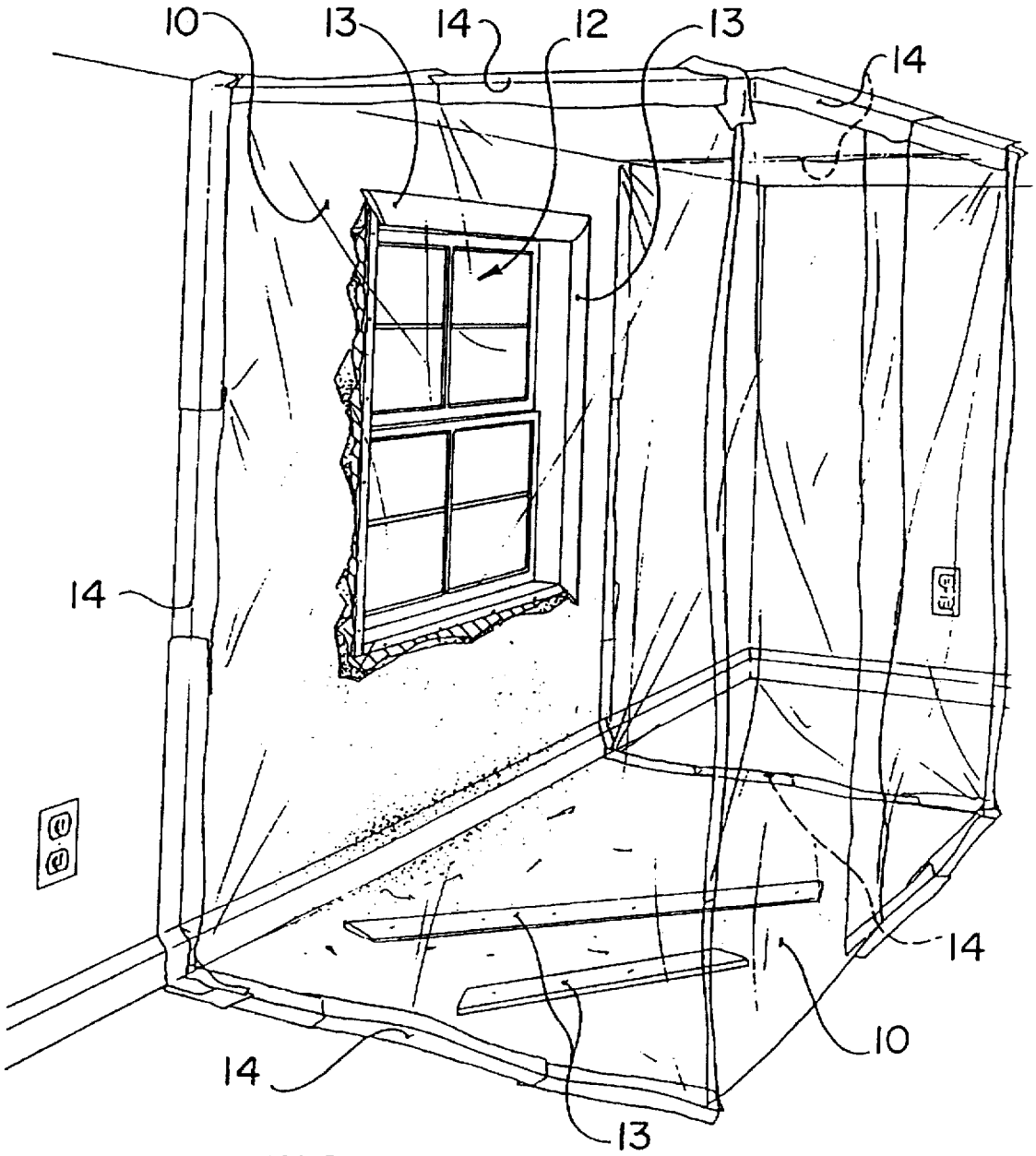
FIG. 1 PRIOR ART
FIG. 1 is a pictorial view of the prior art method using plastic for containing dust and debris from entering the living area while removing a window frame.
Figure 2:
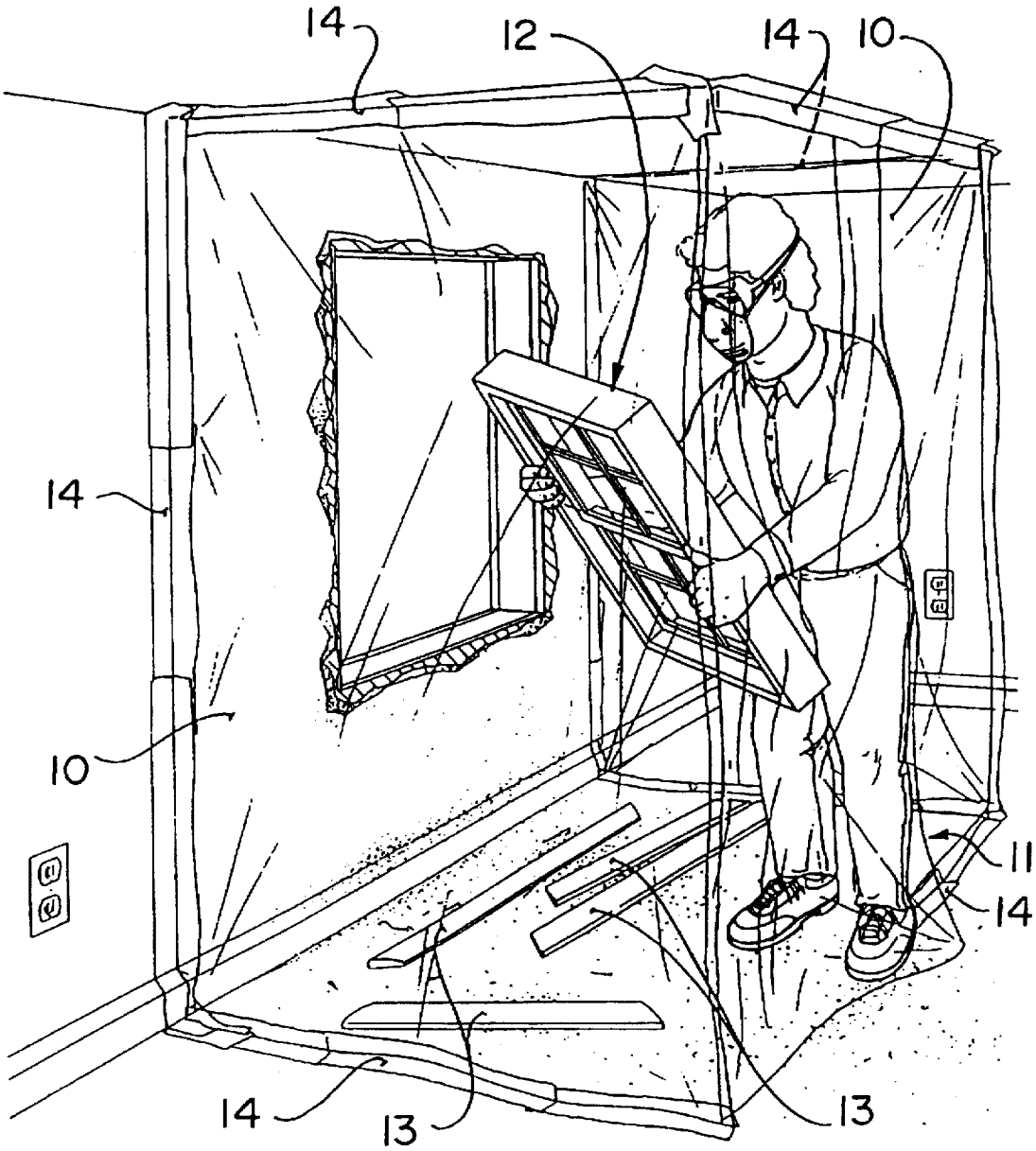
FIG. 2 PRIOR ART
FIG. 2 is a pictorial view showing the prior art plastic containment method of window and frame removal.

With reference to FIGS. 1 and 2 a plastic enclosure 10 with workman's entrance 11 surrounds the window 12 and frame 13 that is being removed, by a workman as done in the prior art. The plastic 10 is held in place by tape 14 which has the potential for marring surfaces when it is removed. And further the plastic 10 itself has the potential for being torn. Moreover, the plastic 10 has to be disposed of as a hazardous toxic material.

Figure 3:
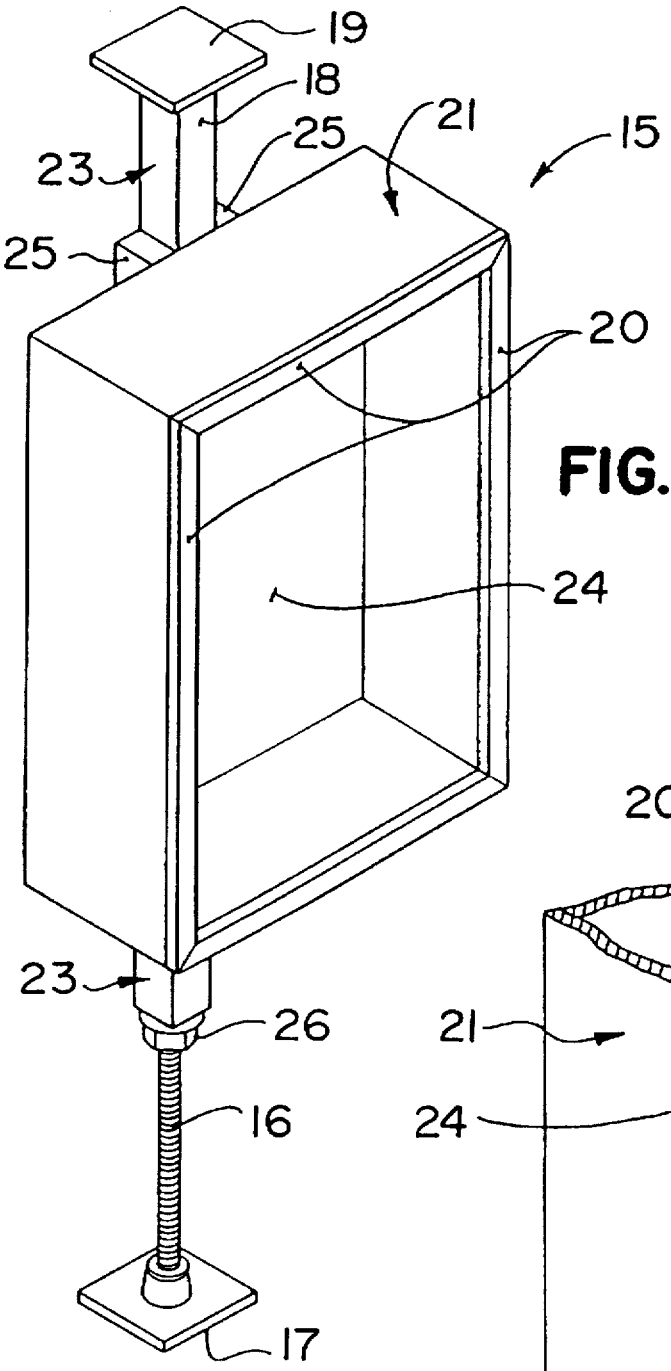
FIG. 3 is a perspective view of the containment box of this invention.

Referring to FIG. 3, the containment box of this invention 15 has a jackscrew 16 and floor pad 17 to engage the floor and a vertical brace 18 and ceiling pad 19 for ceiling support. A foam gasket 20, such as a soft polyurethane foam, surrounds front edge of the box 21 and serves to form a seal against irregular surface areas of the wall against which the containment box is to be placed. The jackscrew 16 is supported on a floor pad 17 and the vertical ceiling brace 18 is fixed to a ceiling pad 19.

Figure 4:
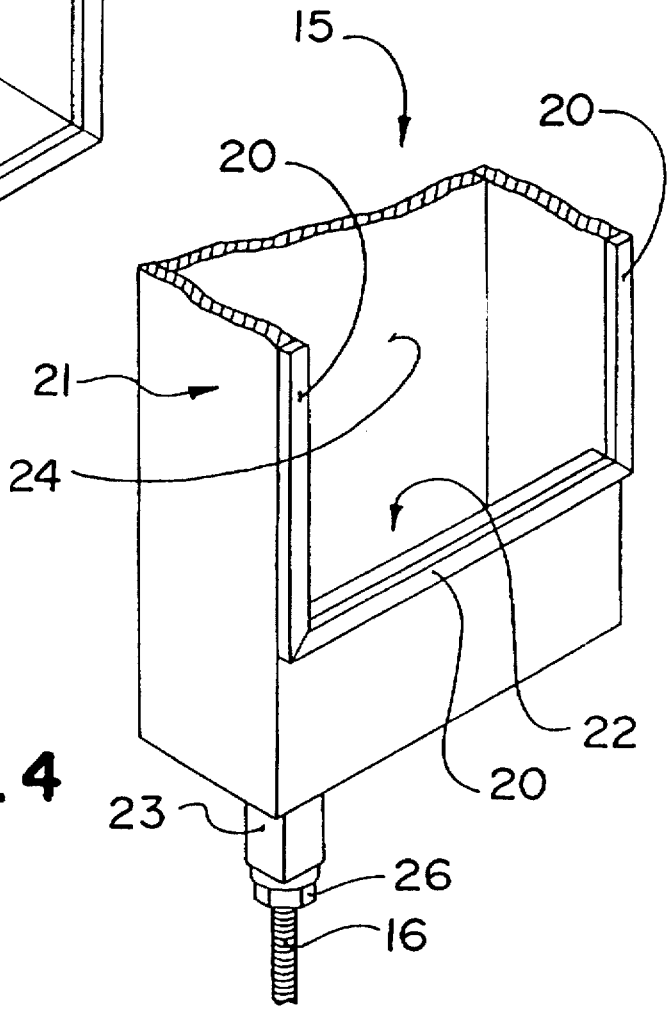
FIG. 4 is a perspective view of a modification of the containment box showing a debris capture compartment. The top of the containment box and jackscrew have been broken away for ease of illustration.

A modification of the containment box 15 (FIG. 4) has a debris capture compartment 22 for capturing falling debris.

A back support 23 (FIGS. 5, 7 and 8) is fixed to the back 24 of the containment box 15 by screws or other fasteners (not shown) which can assure substantial air-tightness of the containment box 15. The jackscrew 16 and ceiling brace 18 are attached to the back support 23. The back support 23 has attached towards its bottom a support block 25 for providing added support for maintaining the containment box 15.

Figure 5:
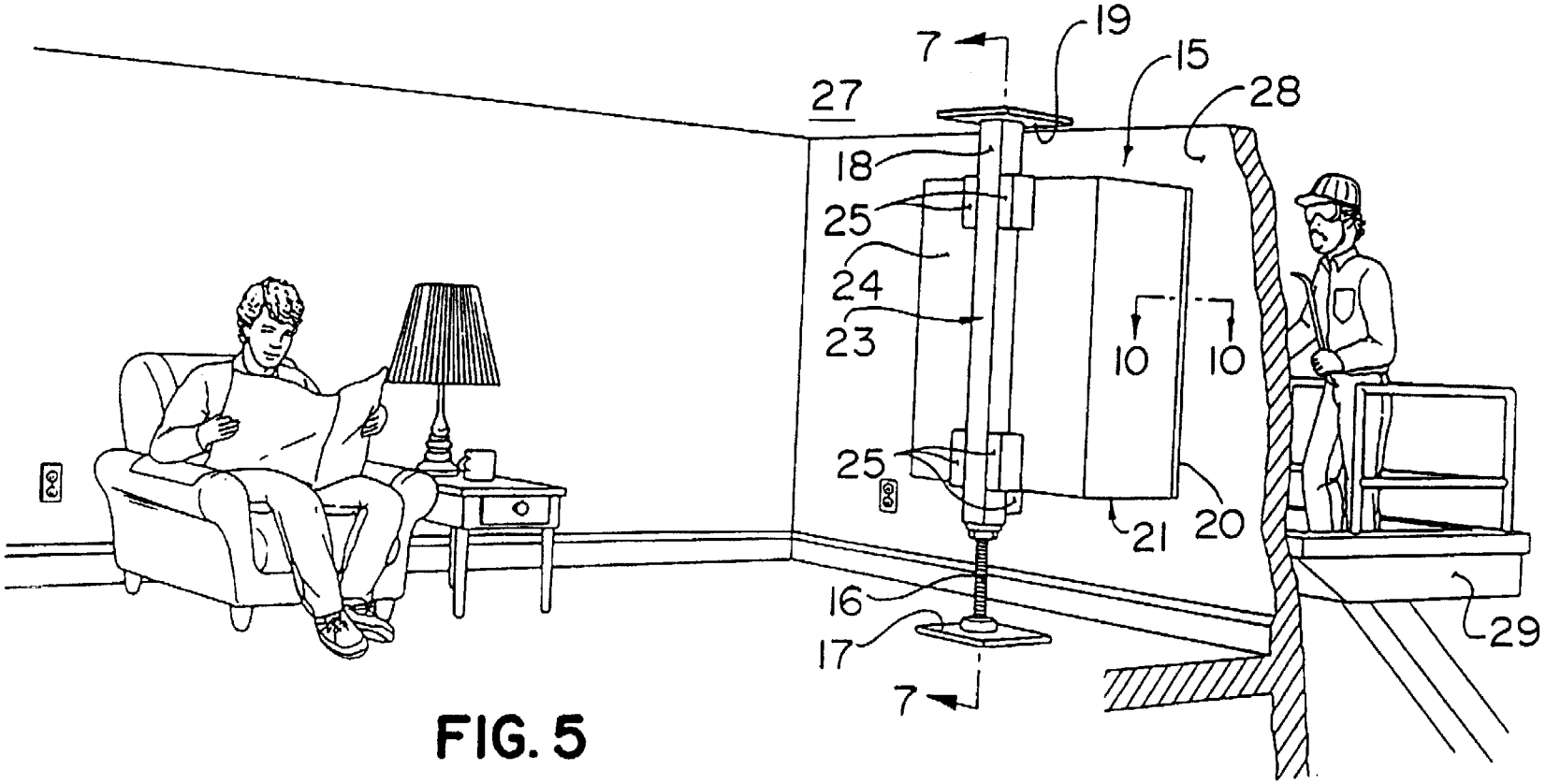
FIG. 5 is a pictorial view of the containment box viewed from inside living area of the building. Part of the wall is shown broken away to show the worker outside of the building about to remove the window frame.

The containment box 15 can be emplaced and a window frame (not shown) removed while people inhabit the building or room (FIG. 5).

Figure 6:
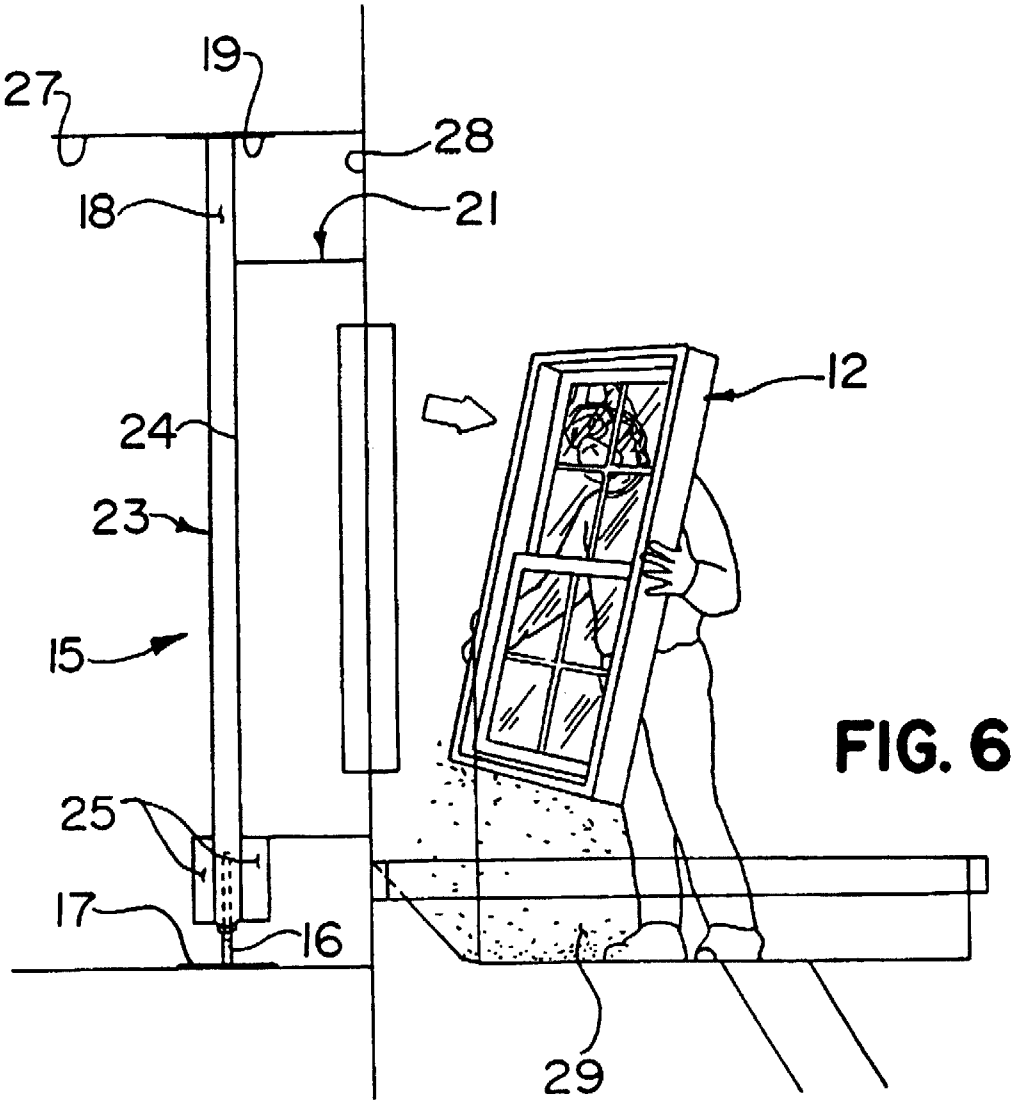
FIG. 6 is a view illustrating the workman outside the building removing the window frame.

A workman on the outside of the building can remove the window frame 13 (FIGS. 5 and 6) while the living area of the building is inhabited.

Figure 10:
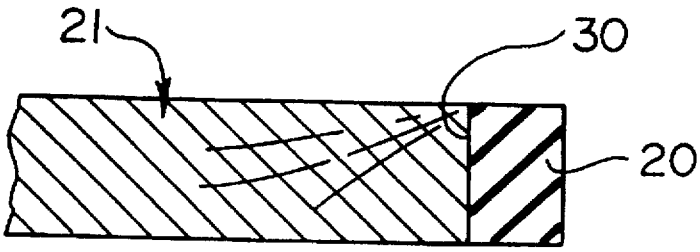
FIG. 10 is an enlarged longitudinal sectional view of the edge of the containment box taken along lines 10—10 of FIG. 5.
Figure 11:
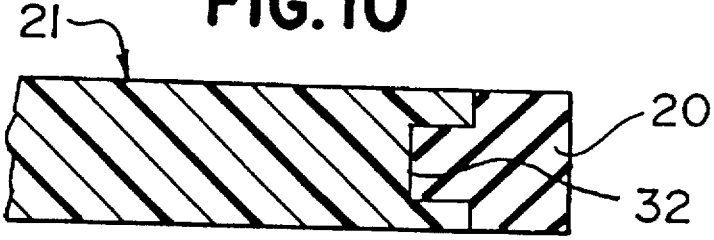
FIG. 11 is an enlarged alternative embodiment of the edge of the containment box taken along lines 10—10 of FIG. 5.
Figure 12:
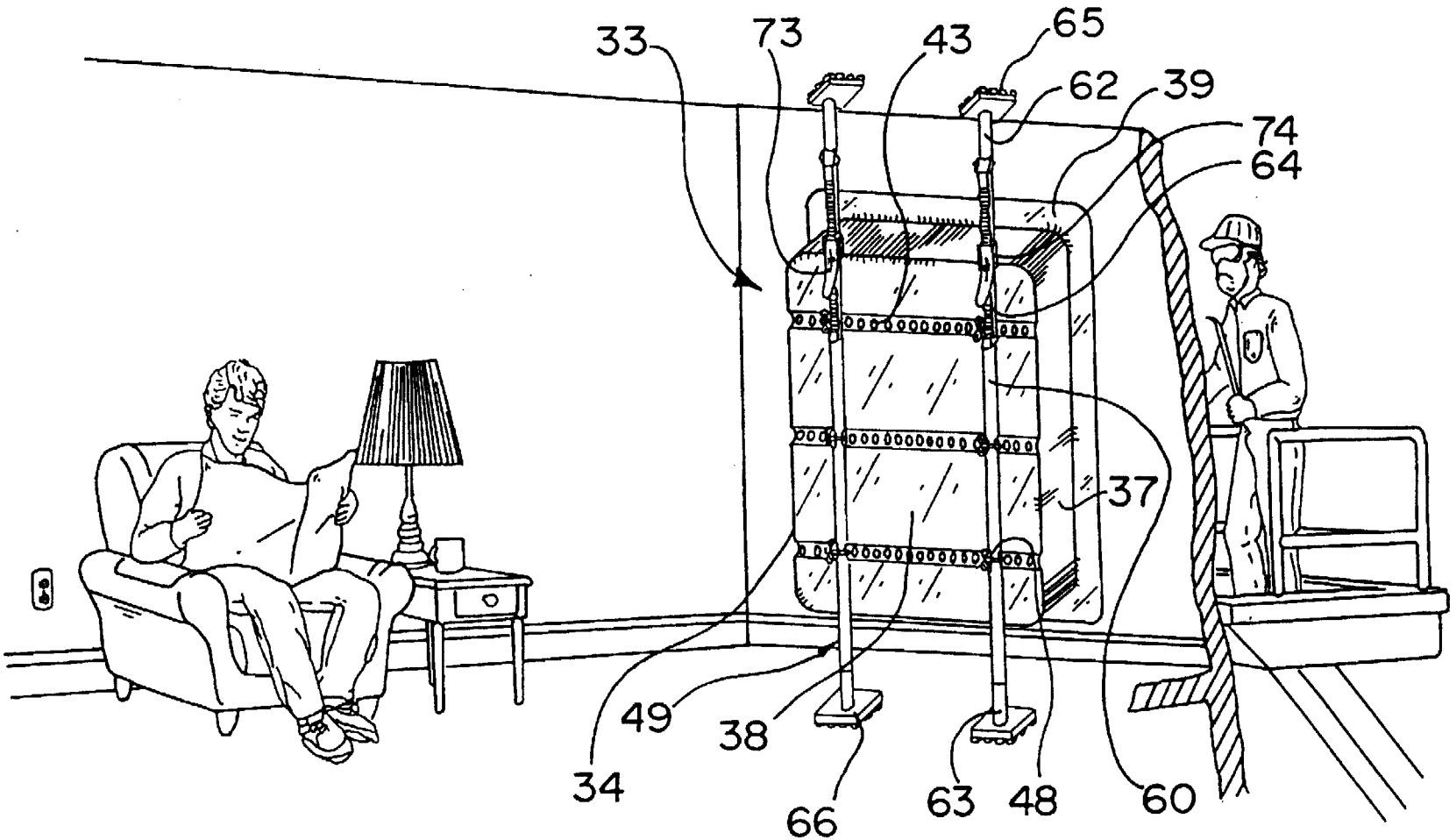
FIG. 12 is a perspective view of yet another modification of the present invention showing a containment box as a molded plastic unit secured on the required height.
Figure 13:
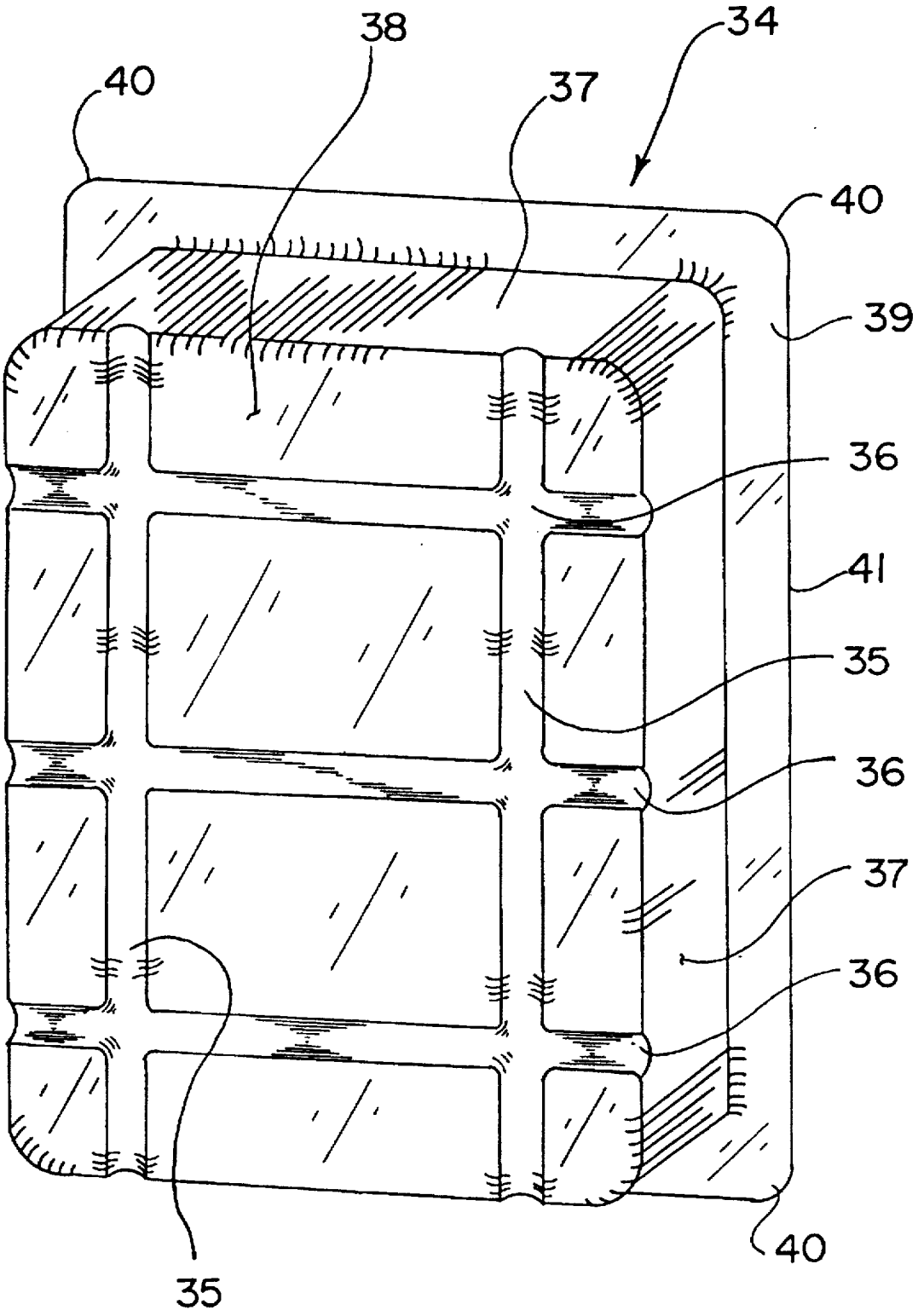
FIG. 13 is a perspective view of the plastic unit of the present invention.
Figure 14:
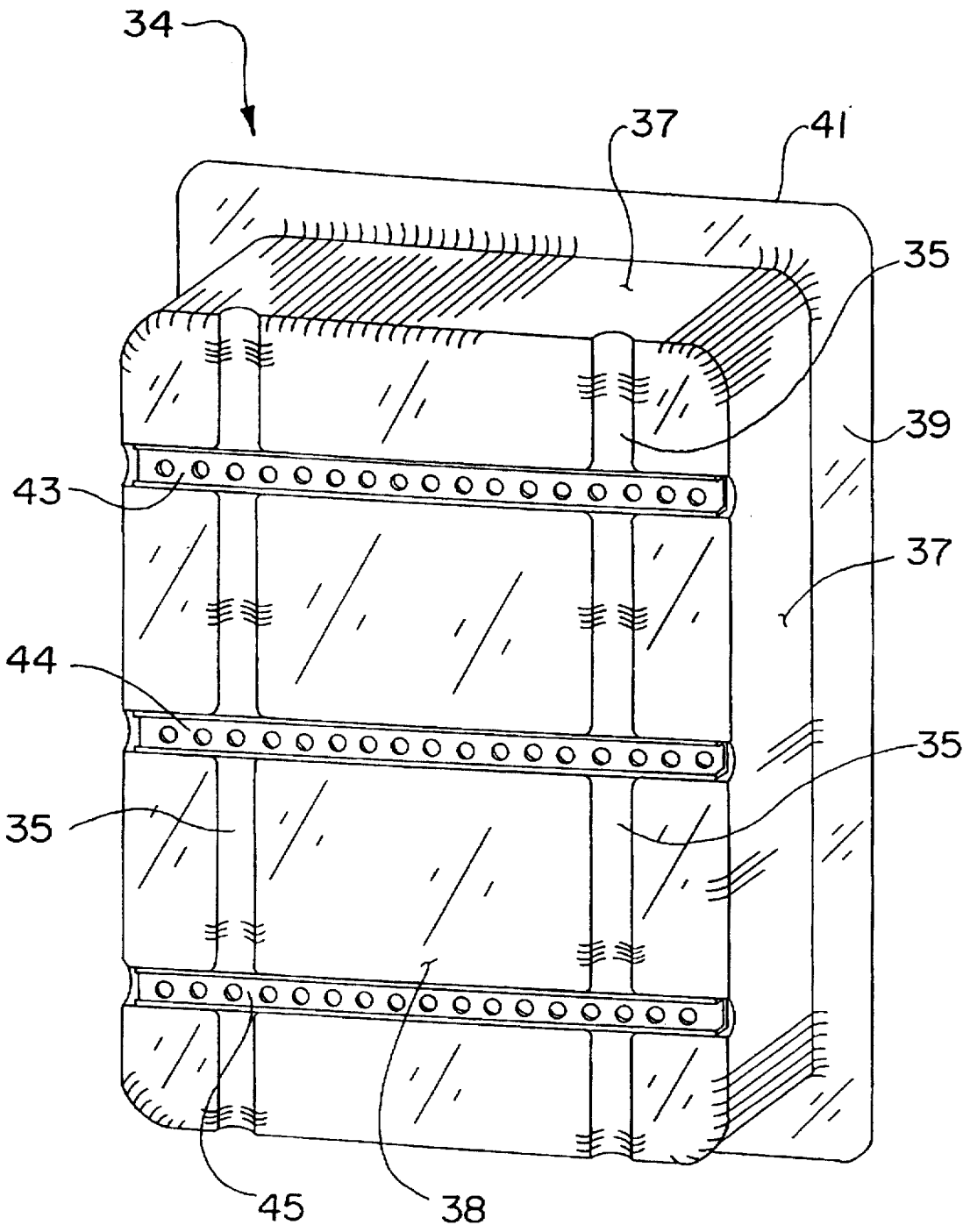
FIGS. 14 and 15 are perspective views of the plastic unit of FIG. 13 with installed metal bars (FIG. 14) and installed fastening means (FIG. 15).
Figure 15:
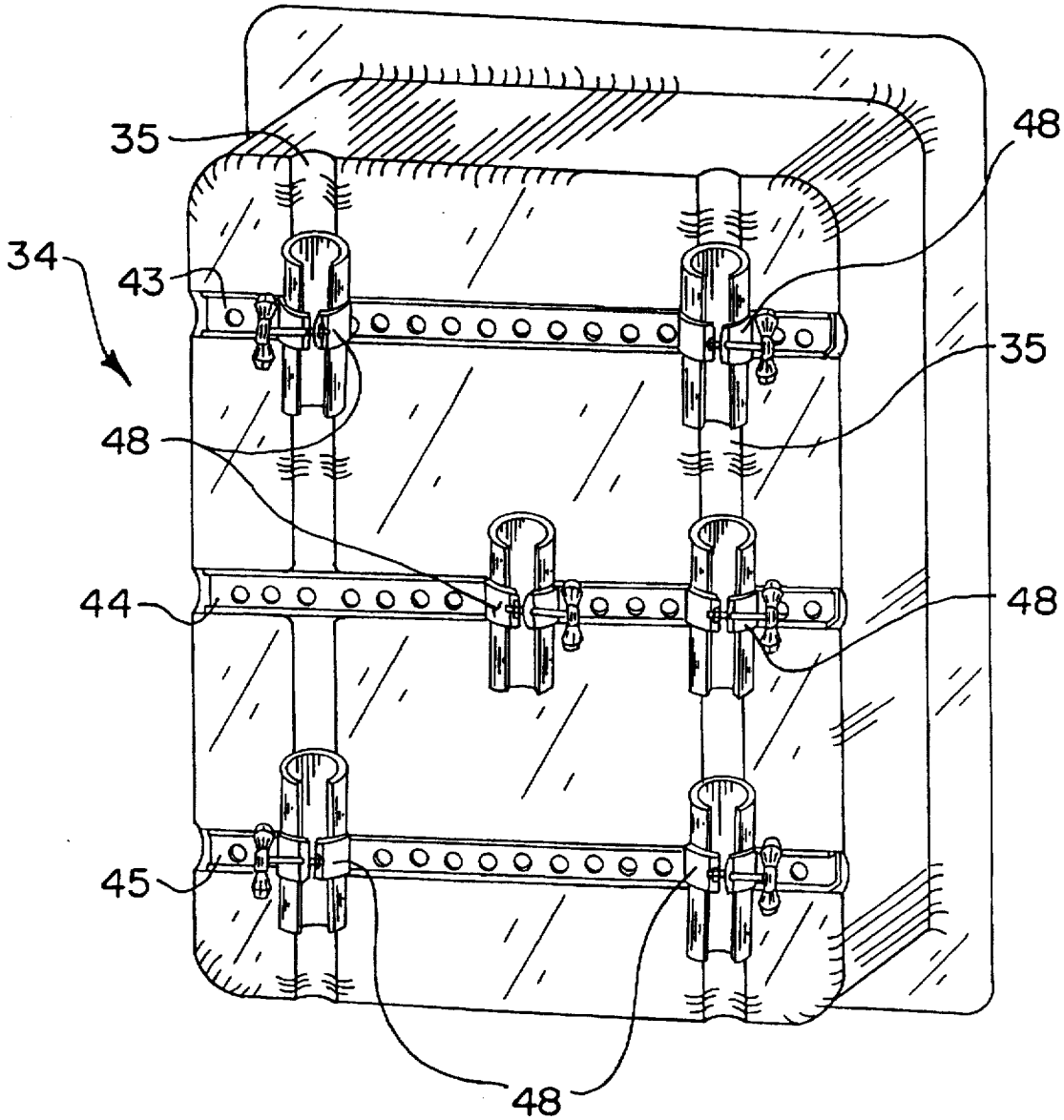

The jackscrew 16 (FIG. 5 shown in detail in FIG. 9) with a turnbuckle nut 26 and floor pad 17 are attached to the bottom of the back support 22 and used to tightened the ceiling brace 18 to the ceiling 27. The containment box 15 is emplaced with a jackscrew 16 (shown in detail in FIG. 9) tightening the ceiling brace 18 against the ceiling 27 and the foam gasket 20 (shown in detail in FIGS. 10 and 11) against the wall 28 to form a substantially airtight occlusion between the containment box 15 and the wall 28.

Figure 7:
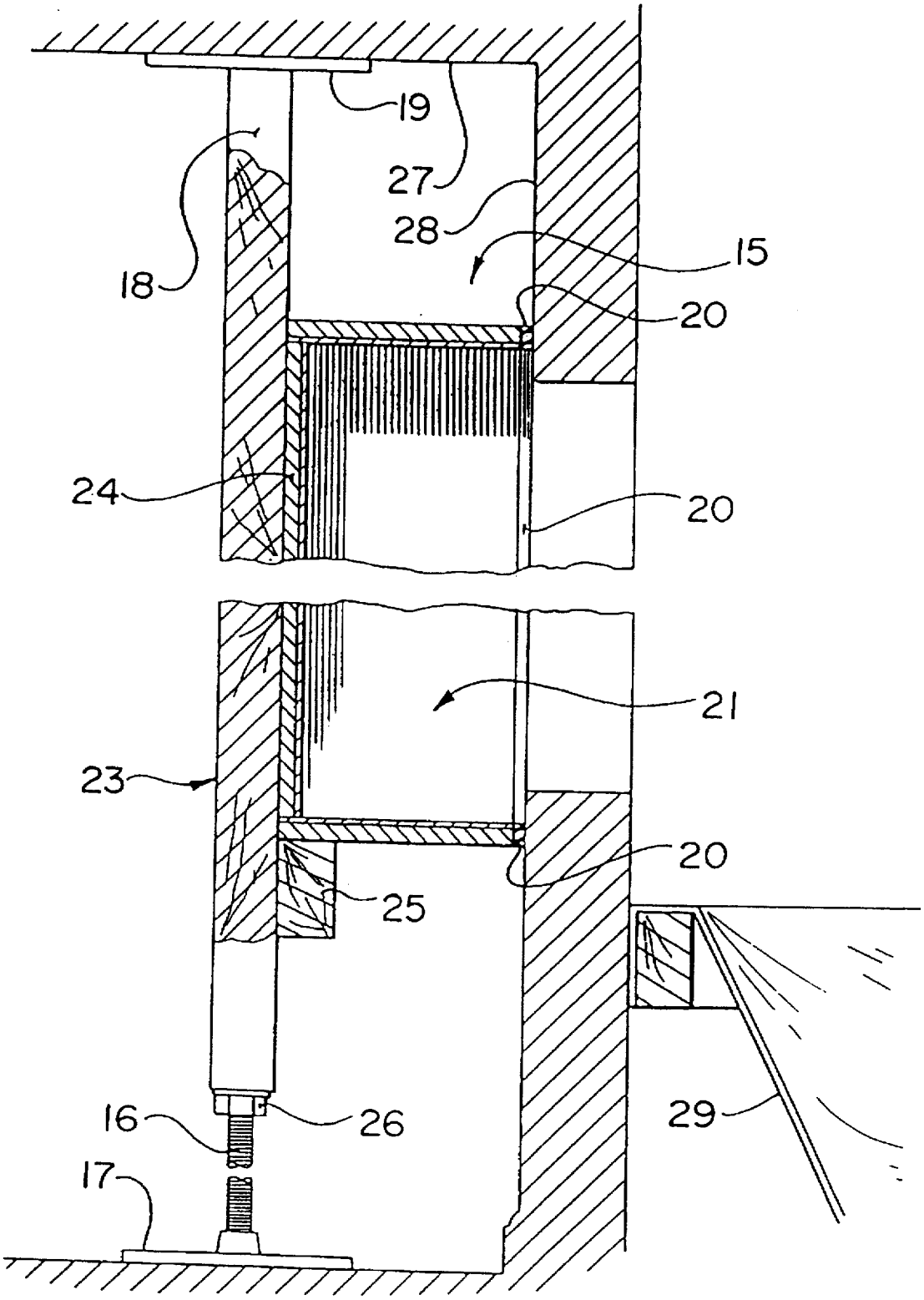
FIG. 7 is a cross-sectional view of the containment box taken along lines 7—7 of FIG. 5 with part of the box and jackscrew being broken away for ease of illustration. Part of the outside standing platform is shown.
Figure 8:
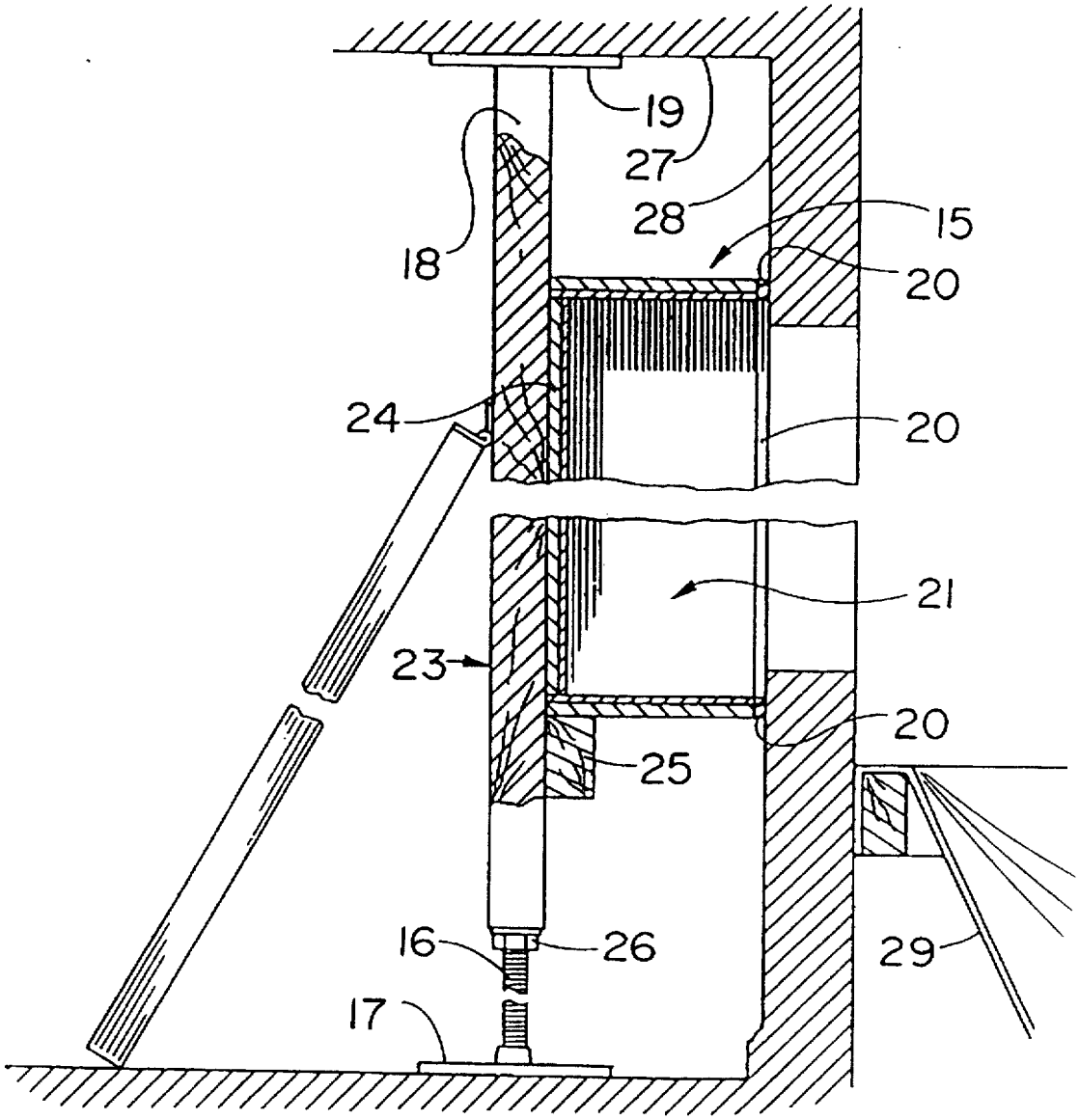
FIG. 8 is a view corresponding to FIG. 7 and showing a back brace for the containment box.

With reference to FIGS. 7 and 8 the containment box 15 is positioned against the wall 28. The gasket 20 forms a seal between the wall 28 and containment box 15. The ceiling brace 18 is fixed to the ceiling 27 by adjusting the jackscrew 16. A worker (not shown) can remove the window frame 13 by standing on the platform 29 outside of the building.

Figure 9:
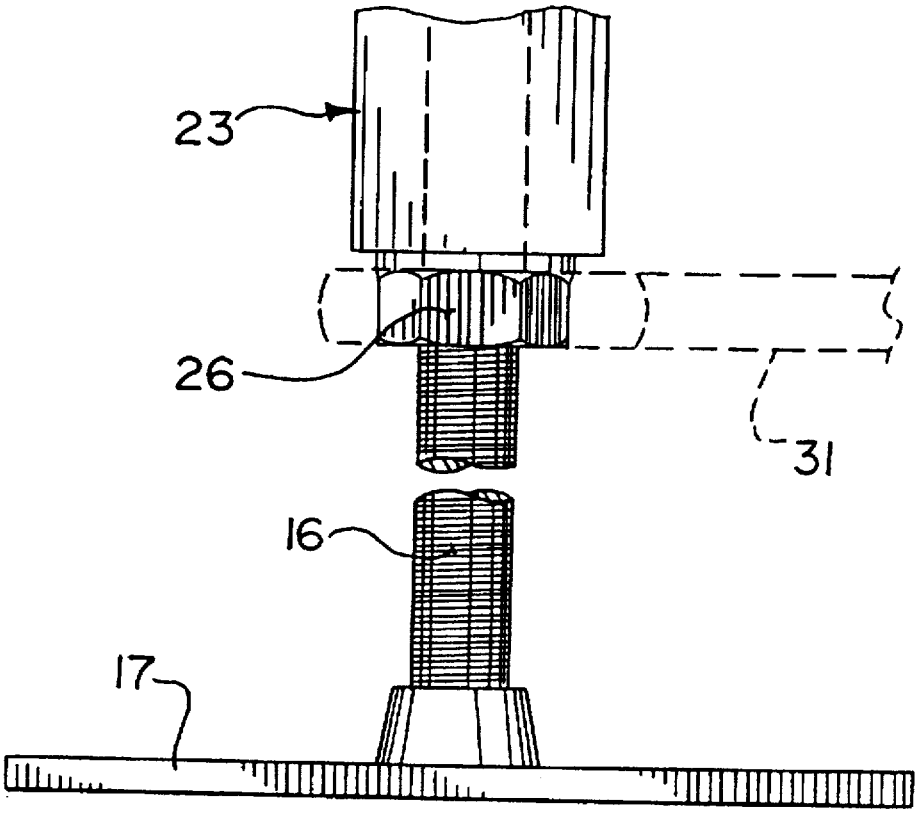
FIG. 9 is an enlarged elevational view of the containment box jackscrew. The wrench for tightening the jackscrew on the containment box is shown in dashed lines.

Referring to FIG. 9 the jackscrew 16 is fitted to a floor pad 17 and a turnbuckle nut 26 is used to tighten the ceiling brace 18 to the ceiling 27 with wrench 31 (shown in dashed lines).

The foam edge or gasket 20 (FIG. 10) of the containment box 15 can be attached by glue 30 or for example by nails or screws (not shown), so long as the containment box 15 remains substantially airtight; or as an alternative embodiment (FIG. 11) can be attached to a plastic containment box by a dove-tail joint 32.

Referring further to FIGS. 12–25, showing a yet another modification of the present invention, further referred to as a pollution abatement apparatus 33, includes a molded-plastic single unitary member (or a plastic unit) 34 adapted to fit against the polluted structure (window, door and the like).

As best shown in FIGS. 12–15, the unit 34 is molded of a plastic transparent material, preferably of Lexan™, and has a pair of longitudinal grooves 35 and three crossing grooves 36. Walls 37 extend from a bottom 38 of the unit 34 and continually surround the bottom 38. The walls 37 end with a ledge 39 which should lean against a wall of the building from which a polluted structure will be removed. Corners 40 of the ledge 39 are rounded and edges 41 of the ledge 39 are smoothed (optionally, a protective material can be installed on the edges 41) to allow the unit 34 to be slid during transportation and set up and to protect exterior of the building from being damaged.

Figure 16:
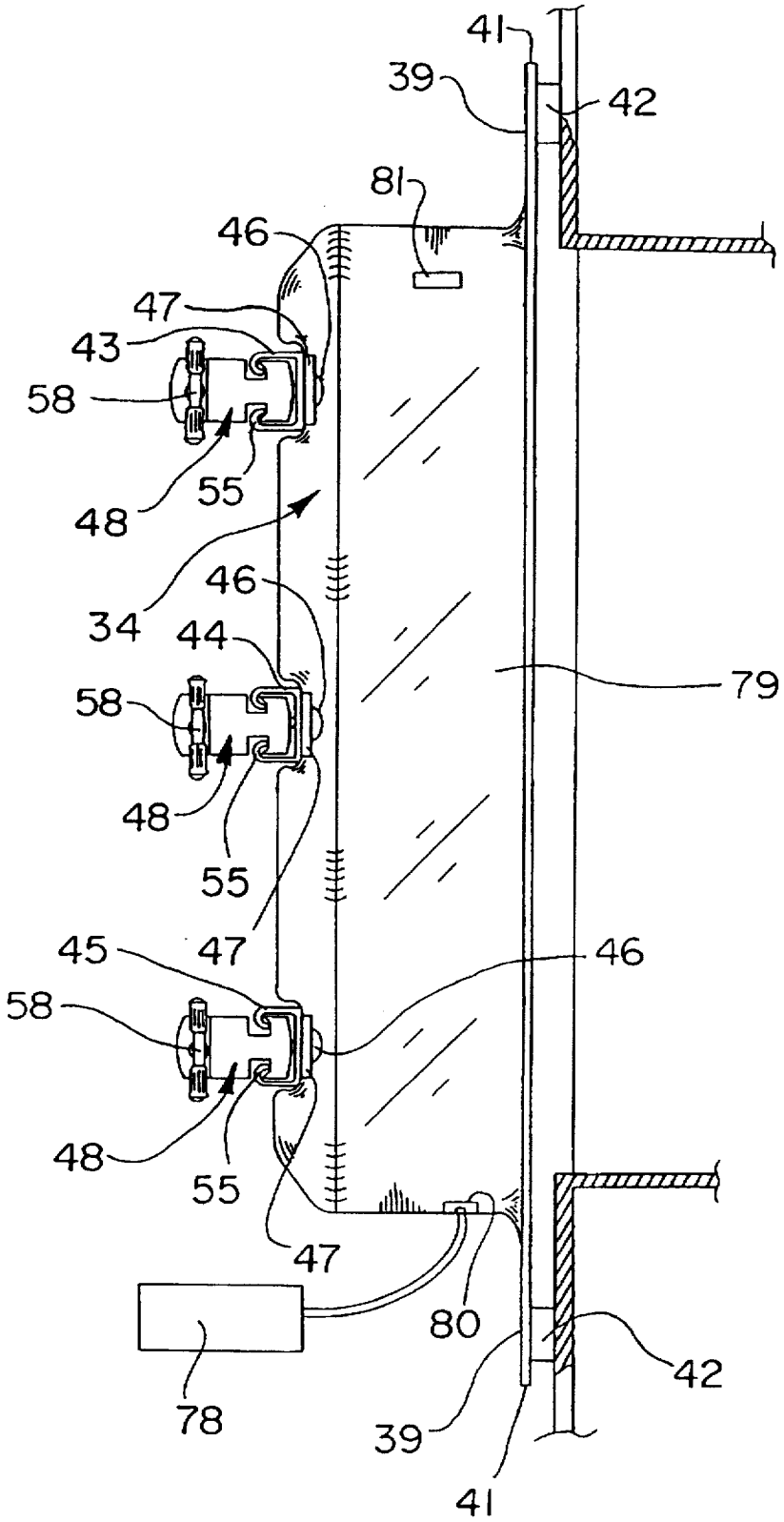
FIG. 16 is a side view of the plastic unit of FIG. 15 showing schematically a suction pump connected to the plastic unit.

As best shown in FIG. 16, a gasket 42 is installed on the ledge 39 for further protection of the wall of the building, and also for a better sealing.

Three metal bars 43, 44, 45 (best shown in FIGS. 14 and 15) are installed within the grooves 36 and secured to the bottom 38 by carriage bolts 46 (best shown in FIG. 16). The bars 43, 44, 45 extend full width of the unit 34 for a better stiffness of the latter.

Figure 23:
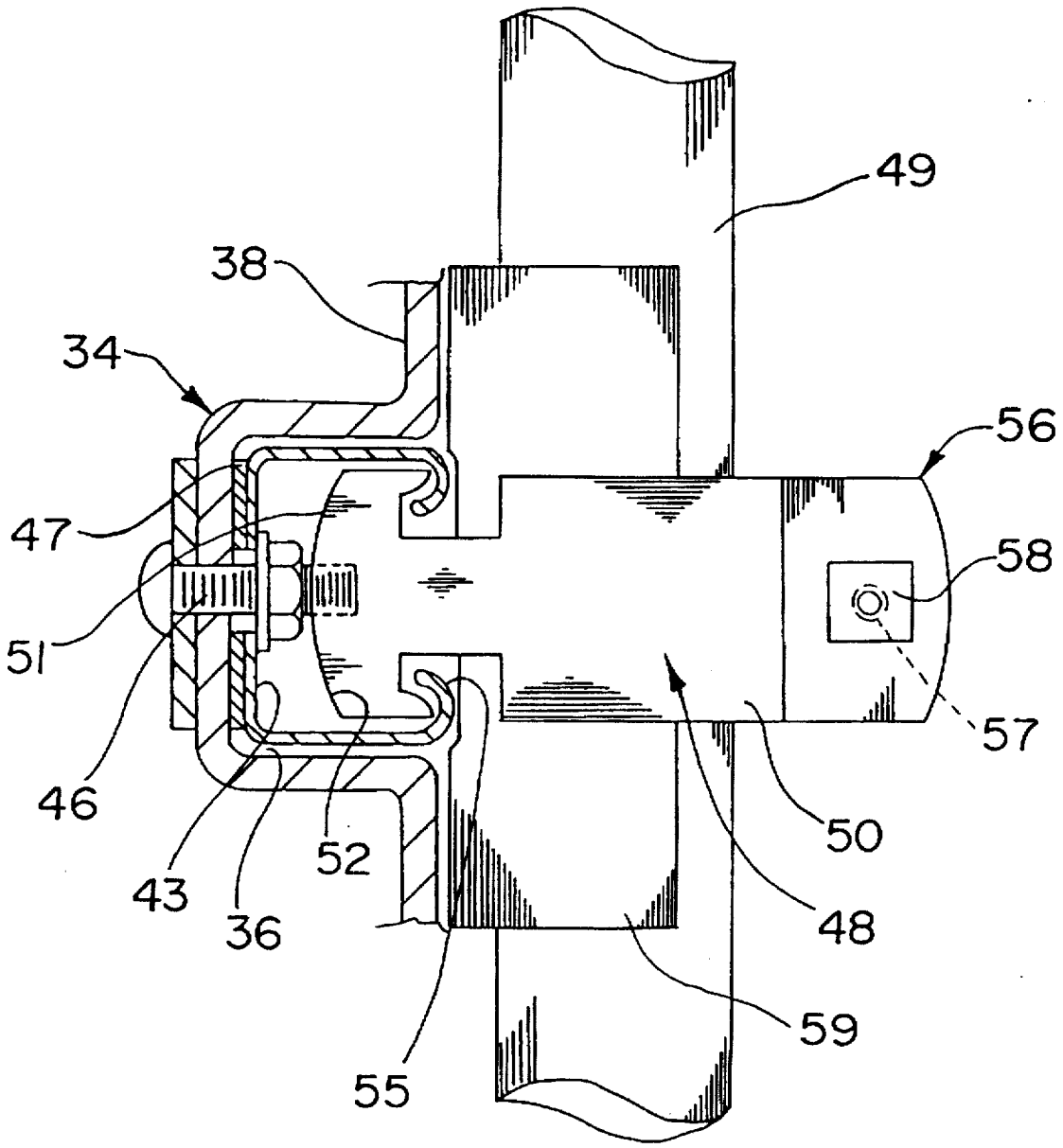
FIG. 23 shows a partial cross-section of the plastic unit of FIG. 20 taken along lines 23—23.

As best shown in FIGS. 16 and 23, a gasket 47 is installed beneath the bars 43, 44, 45 within the grooves 36.

Figure 17:
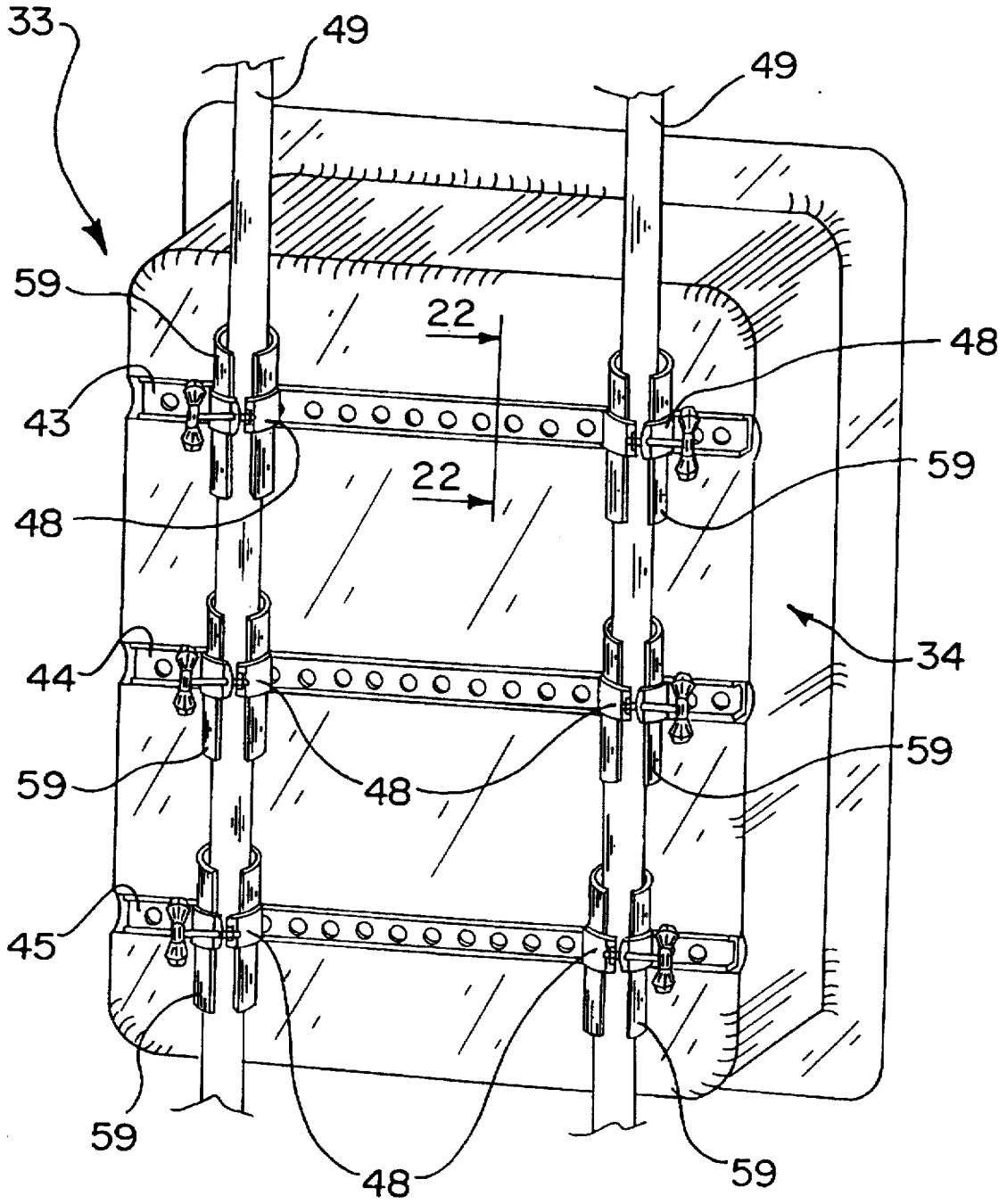
FIG. 17 is a perspective view of the plastic unit with a pair of parallel supporting means.
Figure 18:
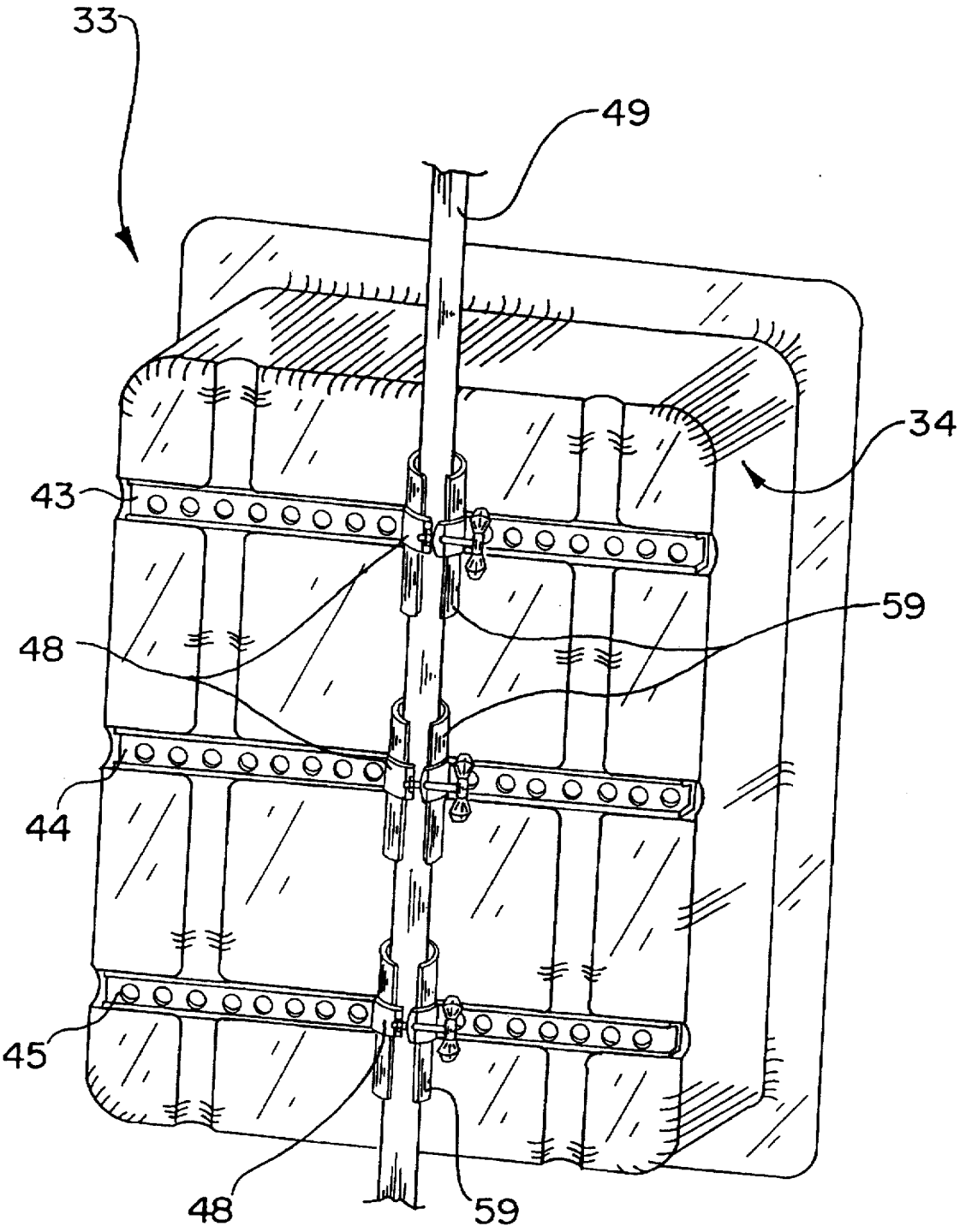
FIGS. 18 and 19 are perspective views of the plastic unit with a single supporting member positioned longitudinally or diagonally, respectively.
Figure 19:
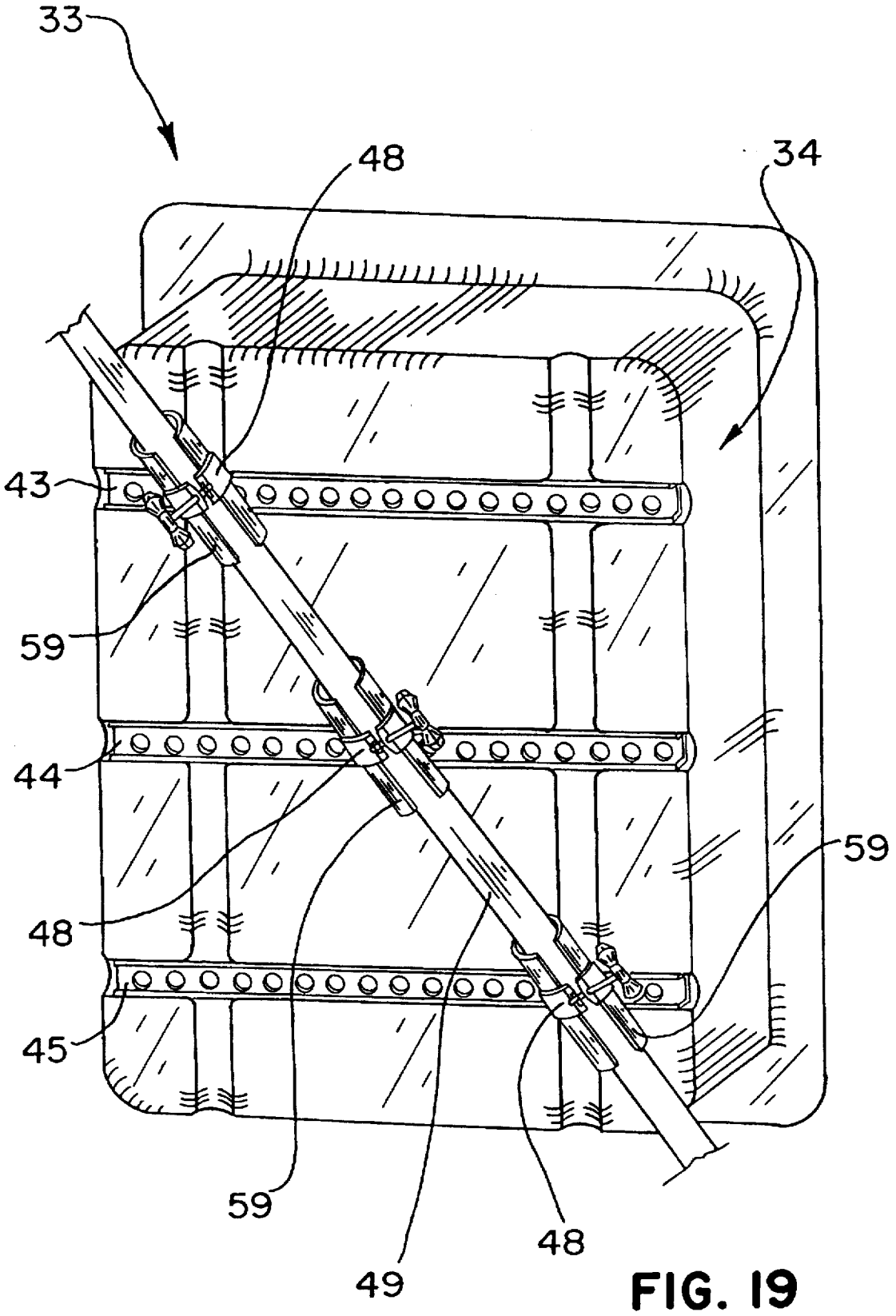

As best shown in FIGS. 15–20, and 22–25, fasteners 48 are secured to the bars 43, 44, 45. The fasteners 48 can be adjusted along the bars 43, 44 and 45 by means known to those skilled in the art, so as to allow supporting members (or jacks) 49 to be positioned as needed for a better work performance. As best shown in FIGS. 17, 18 and 19, either a pair of the supporting members 49 can be employed in parallel spaced-apart arrangement, or a single supporting member 49 can be positioned longitudinally or diagonally.

Figure 20:
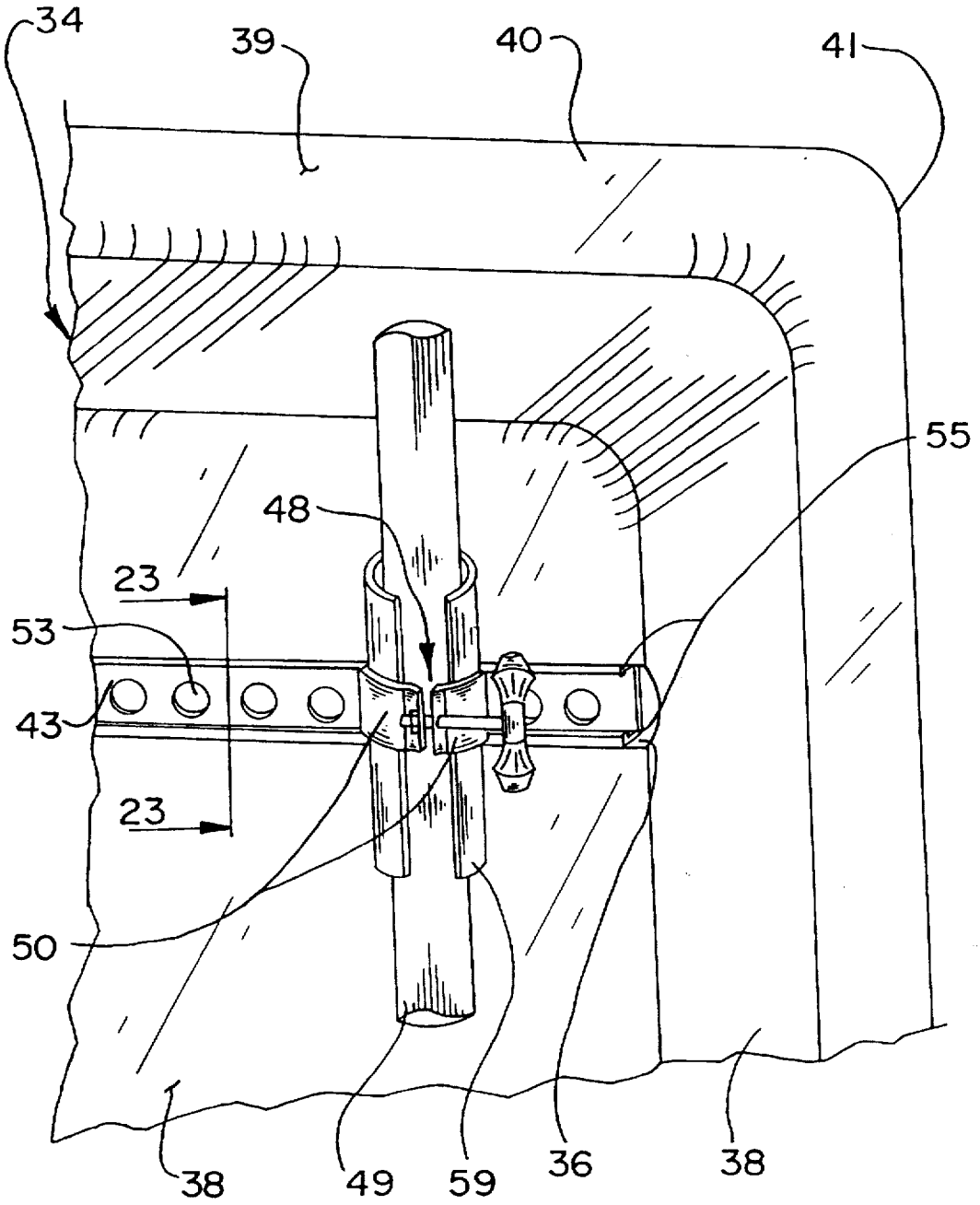
FIG. 20 shows a perspective enlarged partially cut-off view of the supporting member secured to the bottom of the plastic unit of the present invention.
Figure 21:
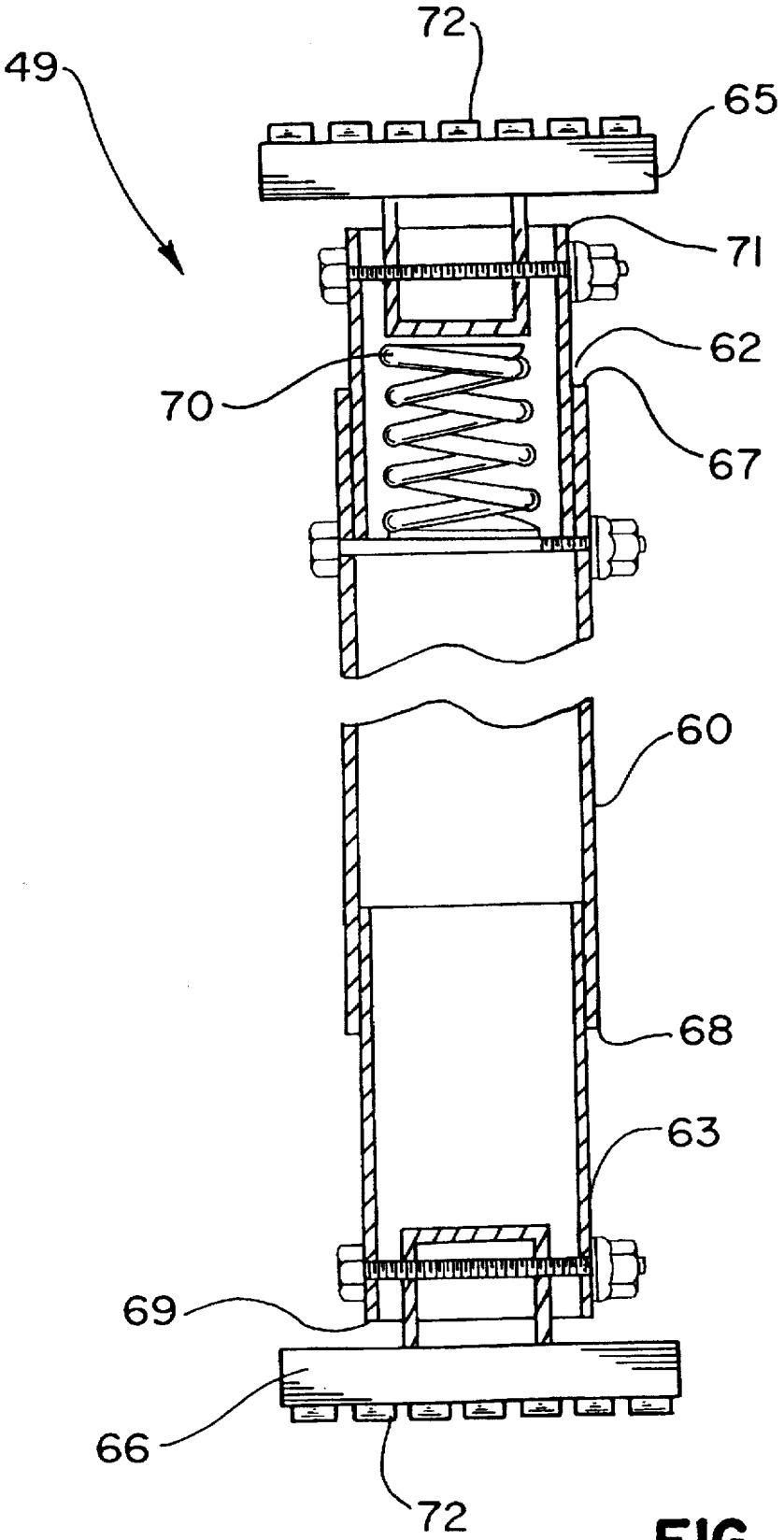
FIG. 21 shows longitudinal cross-section of the supporting member of the present invention.

As best shown in FIGS. 20 and 23, each of the fasteners 48 has a pair of resilient clips (or fingers) 50 embracing the supporting member 49. The fingers 50 are integrally connected at their lower edges 51 by a strip-like body 52 which is pressed against the respective bar 43, 44 or 45 and slides along the latter while the fastener 48 is being adjusted along the bar. A plurality of holes 53 are longitudinally spaced apart along each bar 43–45.

As best shown in FIG. 23, the lower edge 51 of the slip 50 is T-shaped and has a pair of protuberances 54, which being in engagement with side rails 55 of the bars 43, 44, 45, facilitate to secure the fasteners 48 to the bars 43, 44, 45. The upper ends 56 of the clips 50 have openings 57 for passing a threaded bolt with weld nuts 58 which serve for regulation of a degree of clipping the supporting member 49. If the height of the unit 34 is to be adjusted, the fasteners 48 are loosened and the supporting member 49 can freely slide within the clips 50. When the height has been adjusted, the clips 50 are pressed towards each other as close as possible in order to provide immovability of the supporting member 49 within the fasteners 48. The above-described mechanism provides a "rough" height adjustment of the unit 34 between the ceiling and the floor of the building. To facilitate fastening the supporting member 49, each fastener 48 is provided with a semi-cylindrical spacer 59 for positioning between a tubing body 60 of the supporting member 49 and the clips 50, best shown in FIGS. 17–20, and 22–25. In order for the nuts 58 not to be lost, the fastener 48 is provided with a plastic preventing bushing.

As best shown in FIGS. 17–19, 21, 22, 24, and 25, the supporting member 49 has the tubing body 60, a top telescopic member 62, a bottom telescopic member 63, a ratchet mechanism 64, a top edge pad 65 and a bottom edge pad 66. The top and bottom telescopic member 62, 63 can be extended a certain length, each from a respective end 67, 68 of the tubing body 60. The bottom telescopic member can be "arrested" in place by means known to those skilled in the art. The bottom edge pad 66 is pivotally secured to a distal end 69 of the bottom telescopic member 63 to provide a flexibility in setting up the apparatus 33. A spring 70 is installed beneath the top edge pad 65 (and secured within the tubing body 60 by means known to those skilled in the art) in order to provide additional flexibility and some "fine" height adjustment for the apparatus 33. Optionally, the top edge pad 65 can be pivotally secured to the distal end 71 of the top telescopic member 62.

The bottom and the top edge pads, 66 and 65 respectively, may be of any known design which would provide stability for the apparatus 33 when it is installed. In the preferred embodiment, the pads 65 and 66 are not smaller than 4×4 square inches. Also, a surface 72 of the pads 65, 66 engaging the floor and the ceiling of the building is to be ruffled in order to increase friction forces existing between the pads 65, 66 and the ceiling or the floor of the building, thereby improving the rigidity of the installed apparatus 33.

Figure 22:
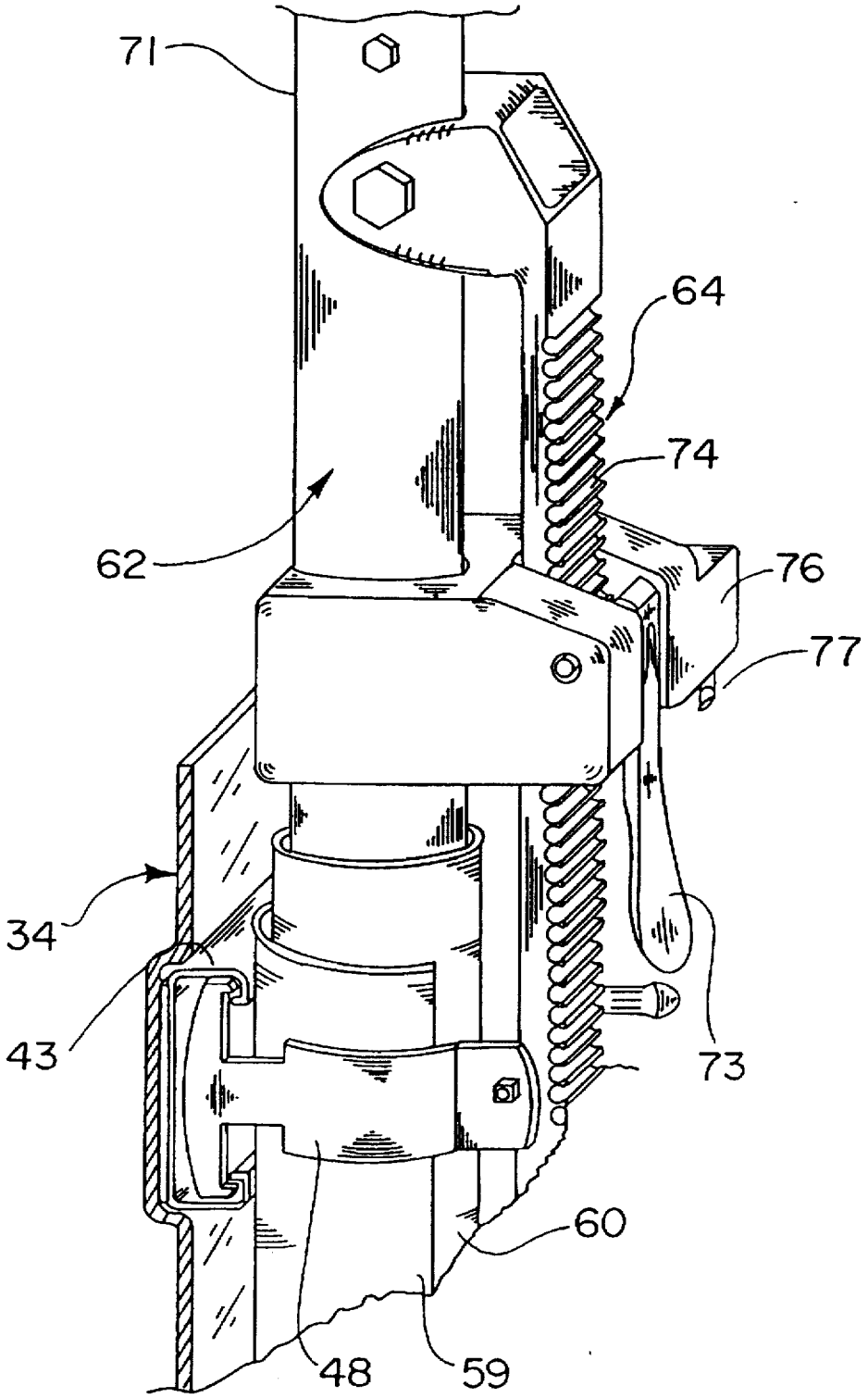
FIG. 22 is a side partial view of the supporting member of FIG. 17 taken along lines 22—22.
Figure 24:
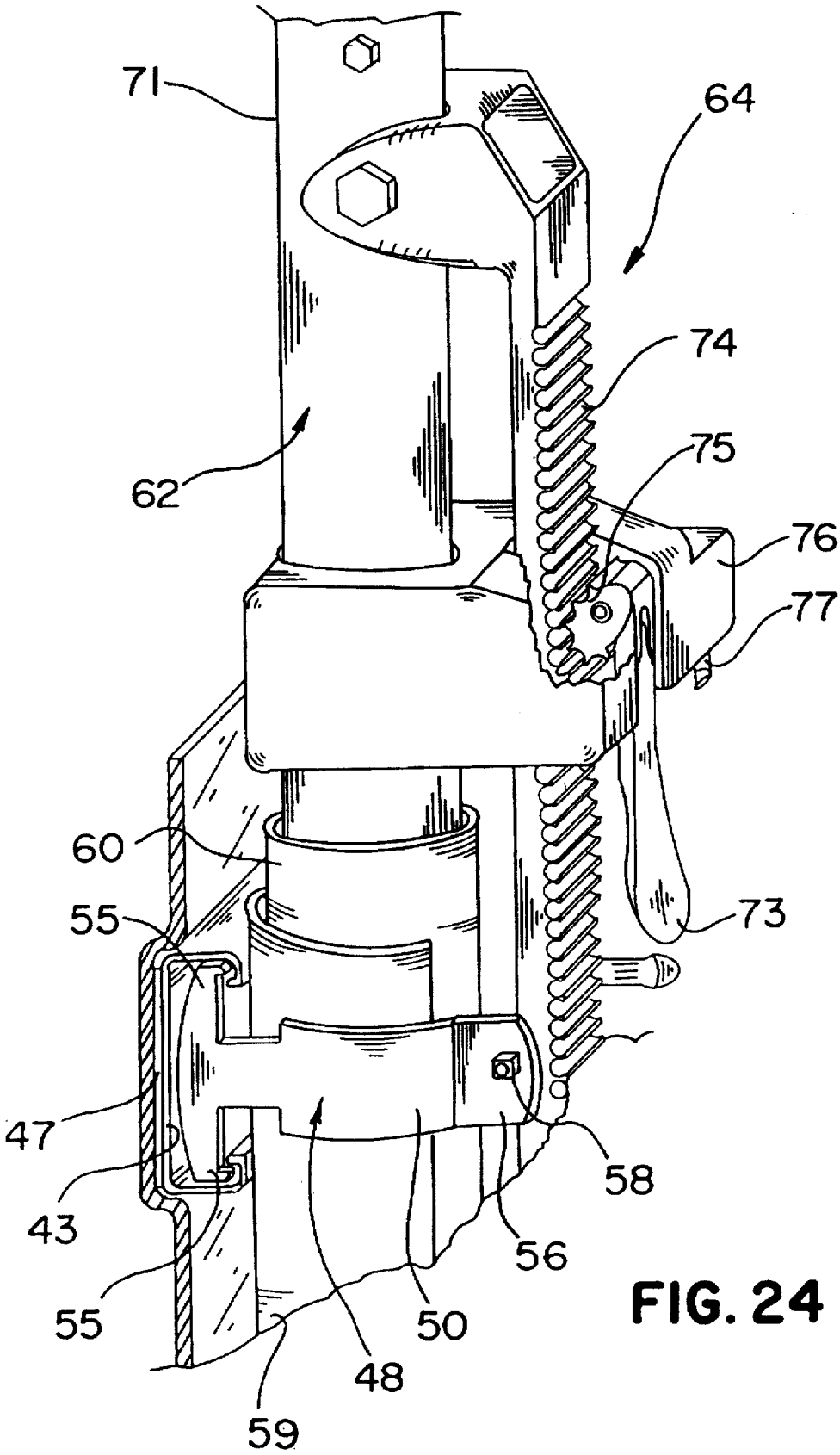
FIGS. 24 and 25 show the clamping means in an "arresting" position and in a "releasing" position, respectively.
Figure 25:
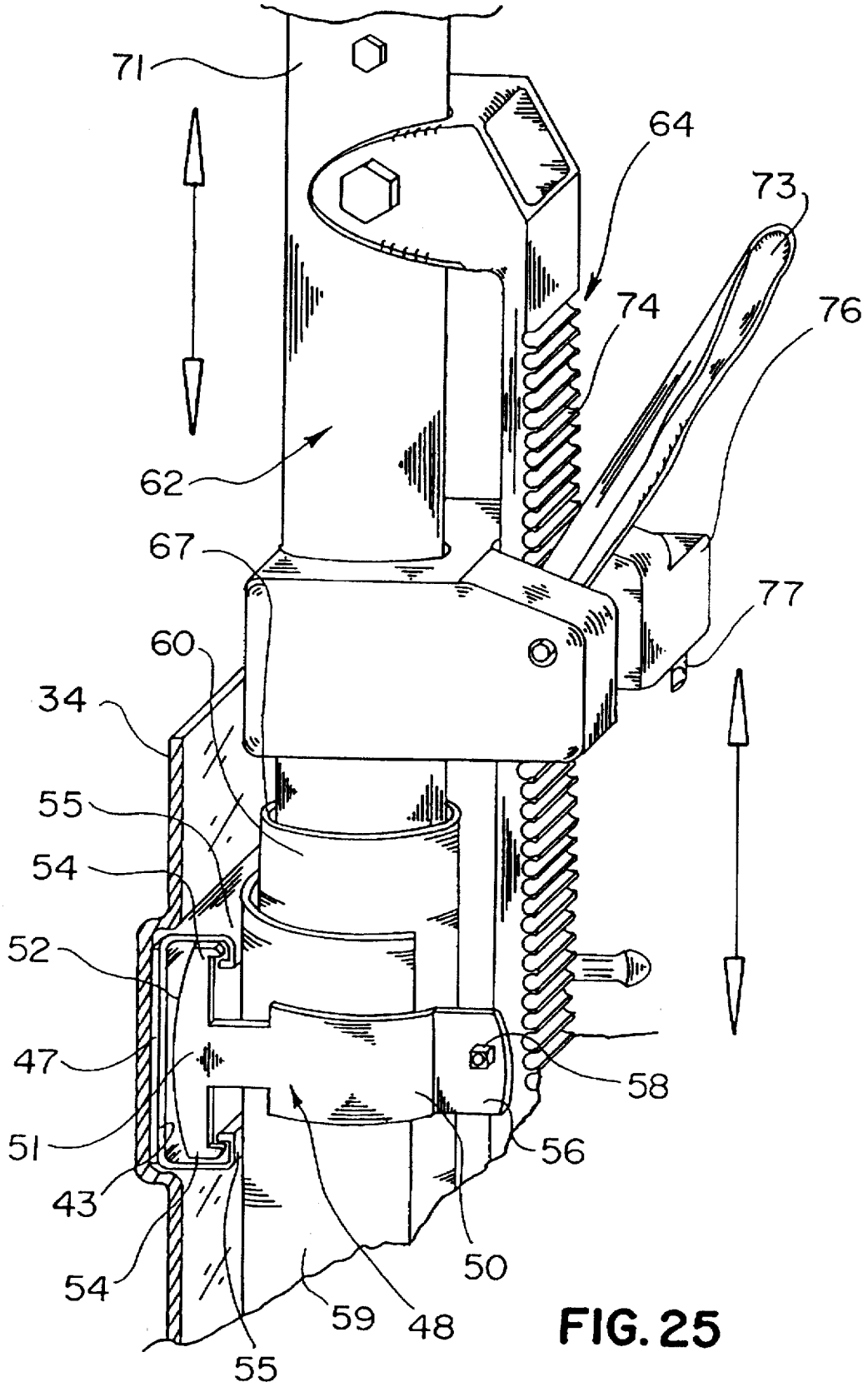

As best shown in FIGS. 22, 24 and 25, a handle grip 73 is secured to the top telescopic member 62 for lifting and positioning the plastic unit 34. The handle grip 73 is secured on the height convenient for a worker. The ratchet mechanism 64, serving for rapidly clamping the plastic unit 34 between the floor and the ceiling of the building, is associated with the handle grip 73. The ratchet mechanism 64 includes a ratchet bar 74 and a ratchet pawl 75 associated with the handle grip 73. While the pawl 75 is released (as in FIG. 25), a handle grip holder 76 can move reciprocally along the ratchet bar 74, and the top telescopic member 62 can be adjusted relative to the tubing body 60 of the supporting member 49. As soon as the height adjustment is accomplished, the handle grip 76 is closed (as best shown in FIG. 24), thereby activating the pawl 75 to "arrest" any further movement of the top telescopic member 62 relative to the tubing body 60. The handle grip holder 76 includes a spring biased lock 77 which should be released prior to opening the handle grip 73 if further height adjustment is needed, or if the work is over. The ratchet mechanism 64 serves for additional, or "fine" height adjustment after the "rough" height adjustment has been done (as described above)and for clamping the plastic unit 34 after both the "rough" and the "fine" height adjustments have been done.

When the polluted structure (a window, a door, or a wall of the building) is to be removed, the apparatus 33 is brought into the building and removably installed within the building, such that the plastic unit 34 is installed on a certain height (by means of the "rough" and the "fine" height adjustment) such that the ledge 39 of the plastic unit 34 surrounds the polluted structure to be removed. The plastic unit 34 is clamped on the required height in the air tight manner such that not to allow any pollutant to penetrate into the building. Additional sealing is provided by the gasket 42. Also, optionally a vacuum can be created by a hepa-vacuum or negative air machine 78 (schematically shown in FIG. 16) which would hold the plastic unit 34 sealed to the wall of the building until the polluted structure is removed.

After the polluted structure has been removed (from outside of the building), any dust and debris are removed from the interior 79 of the plastic unit 34 by the machine 78 (schematically shown in FIG. 16). A hepa-vacuum or negative air machine hook-up 80 is provided on the plastic unit 34 for connecting an inlet of the machine 78 to the unit 34 when needed.

Each plastic unit 34 is provided with a tag 81 identifying a size of the plastic unit 34. Also, the tag 81 may carry a logo.

A leveling device is provided to facilitate installing the apparatus 33 against the polluted structure.

Employing the pollution abatement apparatus of this invention, while structural modifications are taking place, occupants of the building do not have to move out to a hotel, etc., which can be expensive. The inhabitants can remain at home while the windows and frames are removed and replaced.

In many instances a new window frame is not available and the replacement of the removed window frame cannot be done for several days. In that event, the apparatus 33 can be left in place for these several days. This protects the inside of the apartment or other inhabited spaces against the weather, and allows the sunlight into the building. Also, due to transparency of the Lexan™ plastic unit 34, it does not prevent light from outside to come into the building, when the plastic unit 34 is installed. Also, people can look through the plastic unit to watch, for example, their kids playing outside while the polluted structure is being removed. In addition the apparatus left in place is effective for providing security. Once the new window is installed the apparatus can be removed.

With the apparatus and method of this invention, the operator can remove three or four times as many windows as the prior art methods used in industry.

Most importantly, with the use of the disclosed invention the occupants are not exposed to toxic lead or other pollutants; and furniture, which does not have to be moved out of the area, remains clean.

A most significant feature of this invention is the fact that the apparatus is easy to install and easy to remove.

The fact that the plastic unit after detoxification, unlike plastic sheeting, can be used over and over again is a major benefit accruing from the use of this device.

Unlike plastic film, the apparatus of this invention does not present a disposal problem; and secondly, there is not the problem of having to repair torn plastic; and finally, and most significantly, plastic film has to be taped to walls, ceiling and floor, which is time consuming and equally important is the fact that tape application is liable to leave marks or remove paint on the wall surface when it is removed.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. In a building including an interior having a floor and a ceiling, and further having a polluted structure disposed vertically between the floor and the ceiling, a pollution abatement apparatus for removing the polluted structure from externally of the building, the apparatus comprising:

a single unitary rigid member clamped between the floor and ceiling and adapted to fit against the polluted structure within the interior of the building and to surround the polluted structure in a substantially air-tight relationship, thereby precluding a pollutant from polluting the interior of the building as the polluted structure is removed from externally of the building, and at least one adjustable supporting member supporting the single unitary rigid member against the polluted structure within the interior of the building.

2. The pollution abatement apparatus of claim 1, further comprising:

handle means carried by the single unitary member for lifting the single unitary member and positioning the single unitary member against the polluted structure, and ratchet-actuated clamping means associated with the handle means for rapidly clamping the single unitary member between the floor and the ceiling.

3. The pollution abatement apparatus of claim 1, wherein the single unitary member is a plastic molded transparent unit.

4. The pollution abatement apparatus of claim 1, further including a means attached to the single unitary member for connecting a negative air machine to the single unitary member.

5. In a building including an interior having a floor and a ceiling, and further having a polluted structure in a wall disposed vertically between the floor and the ceiling, a pollution abatement apparatus for removing the polluted structure from externally of the building, the apparatus comprising:

a single unitary rigid member clamped between the floor and the ceiling and adapted to fit against the polluted structure within the interior of the building and to surround the polluted structure in a substantially air-tight relationship, thereby precluding a pollutant from polluting the interior of the building as the polluted structure is removed from externally of the building, and at least one adjustable supporting member supporting the single unitary rigid member against the polluted structure within the interior of the building, wherein the single unitary rigid member includes:

a bottom, walls extending from the bottom and continually surrounding the bottom of the single unitary rigid member, a ledge for leaning against the wall of the building and surrounding the polluted structure, and three bars crossing the bottom of the single unitary rigid member in spaced-apart arrangement and extending substantially a whole width of the single unitary rigid member.

6. The pollution abatement apparatus of claim 5, further including means carried by the single unitary rigid member for providing a "rough" height adjustment of the apparatus between the floor and the ceiling, wherein the means for "rough" height adjustment includes said at least one supporting member, along which the single unitary member reciprocally slides, wherein said at least one supporting member comprises:

a tubular body, a top edge pad for leaning against the ceiling, and a bottom edge pad for leaning against the floor, and wherein at least one fastening means is removably secured to each of said three bars for removably securing said at least one supporting member to the single unitary rigid member.

7. The pollution abatement apparatus of claim 6, further including a pair of spaced apart substantially parallel said supporting members, each being secured to respective edges of said three bars.

8. The pollution abatement apparatus of claim 6, wherein the supporting member is secured substantially to centers of said three bars.

9. The pollution abatement apparatus of claim 6, wherein the supporting member is secured diagonally to said single unitary member.

10. The pollution abatement apparatus of claim 6, wherein said fastening means includes a pair of clips embracing the supporting member, and wherein the clipping of the supporting member between said pair of the clips is regulated from loosen to immovable by a weld nut, thereby allowing the "rough" height adjustment of the single unitary member.

11. The pollution abatement apparatus of claim 10, further including semi-cylindrical spacers, each being positioned between the tubing body and respective resilient clips.

12. The pollution abatement apparatus of claim 6, wherein the supporting member has a telescoping top member, which is adjustably extended a certain length from a top end of the tubular body of the supporting member, thereby allowing a "fine" height adjustment for the single unitary member.

13. The pollution abatement apparatus of claim 12, wherein the top edge pad is pivotally secured to a distal end of the telescopic top member.

14. The pollution abatement apparatus of claim 12, wherein the top edge pad is secured to a distal end of the telescopic top member, and wherein a spring is installed beneath the top edge pad.

15. The pollution abatement apparatus of claim 6, wherein the supporting member has a telescopic bottom member, which, being extended a certain length from a lower end of the tubular body of the supporting member, allows additional height adjustment for the single unitary member.

16. The pollution abatement apparatus of claim 15, wherein the bottom edge pad is pivotally secured to a distal end of the telescopic bottom member.

17. The pollution abatement apparatus of claim 6, wherein the top and the bottom edge pads are not smaller than 4×4 square inches.

18. The pollution abatement apparatus of claim 5, wherein the bars are made of a metal.

19. The pollution abatement apparatus of claim 5, wherein each of said bars has a plurality of holes longitudinally spaced apart along each said bar.

20. The pollution abatement apparatus of claim 5, wherein each of said bars is secured to the bottom of the single unitary member by at least a pair of bolts longitudinally spaced apart along each said bar.

21. The pollution abatement apparatus of claim 5, wherein the bottom of the single unitary member has respective crossing grooves extending substantially the whole width of the single unitary member, and wherein each bar is secured within a respective crossing groove.

22. The pollution abatement apparatus of claim 5, further including a gasket installed between each of said bars and the bottom of the single unitary member.

23. The pollution abatement apparatus of claim 5, wherein each of said bars has side rails, and wherein each said fastening means is adjusted along a respective one of said bars within said side rails.

24. In a building including an interior having floor and a ceiling, and further having a polluted structure in a wall disposed vertically between the floor and ceiling, a pollution abatement apparatus for removing the polluted structure from externally of the building, the apparatus comprising:

a single unitary rigid member adapted to fit against the polluted structure within the interior of the building and to surround the polluted structure in a substantially air-tight relationship, thereby precluding a pollutant from polluting the interior of the building as the polluted structure is removed from externally of the building, and at least one adjustable supporting member supporting the single unitary rigid member against the polluted structure within the interior of the building wherein the pollution abatement apparatus, is a lead-abatement apparatus, and wherein said polluted structure is a window and a window frame disposed in the wall.

25. A method for removing a polluted structure from externally of a building, the building including an interior having a floor and a ceiling, respectively, the method comprising the steps of providing a pollution abatement apparatus, comprising a single unitary member adapted to fit against the polluted structure within the interior of the building and to surround the polluted structure in a substantially air-tight relationship, thereby precluding a pollutant from polluting the interior of the building as the polluted structure is removed from externally of the building, lifting the single unitary member and positioning the single unitary member against the polluted structure by a handle means carried by the single unitary member, and rapidly clamping the single unitary member between the floor and the ceiling within the interior of the building by a ratchet-actuated clamping means associated with the handle means.

26. A method for removing a polluted structure from externally of a building, the building including an interior having a floor and a ceiling, respectively, the method comprising the steps of providing a pollution abatement apparatus, comprising a single unitary member adapted to fit against the polluted structure within the interior of the building and to surround the polluted structure in a substantially air-tight relationship, thereby precluding a pollutant from polluting the interior of the building as the polluted structure is removed from externally of the building, lifting the single unitary member and positioning the single unitary member against the polluted structure by a handle means carried by the single unitary member, and rapidly clamping the single unitary member between the floor and the ceiling within the interior of the building by a ratchet-actuated clamping means associated with the handle means, said method further comprising the step of a "rough" height adjustment and thereafter a "fine" height adjustment of the apparatus between the floor and the ceiling, by actuating the ratchet-actuated clamping means.

27. In a method of removing a polluted structure from the wall in a building, the improvement comprising the steps of providing a rigid containment means, removably installing the rigid containment means within the building, up against the inside of the wall, and surrounding said polluted structure in a substantially airtight manner, thereby confining any dust or debris within the rigid containment means and preventing inadvertent pollution within the building, removing the polluted structure from externally of the building, and removing the rigid containment means.

28. In a method of removing a polluted structure from the wall in a building the improvement comprising the steps of providing a rigid containment means, removably installing the rigid containment means within the building, up against the inside of the wall, and surrounding said polluted structure with said rigid containment means in a substantially airtight manner, thereby confining any dust or debris within the rigid containment means and preventing inadvertent pollution within the building, removing the polluted structure, and removing the rigid containment means, wherein the polluted structure comprises a window and a window frame.

29. The method of claim 28, wherein the window and window frame are removed from outside of the building.

30. The method of claim 28, further including the step of removing any dust or debris from the interior of the rigid containment means, thereby facilitating subsequent re-use of the rigid containment means.

31. A pollution abatement apparatus for removing a polluted structure located on a wall of a building, the building including an interior having a floor and a ceiling, respectively, the apparatus comprising:

a rigid containment means adapted to fit against the polluted structure within the interior of the building and to surround the polluted structure in a substantially air-tight relationship, thereby precluding a pollutant from polluting the interior of the building as the polluted structure is removed, a clamping means carried by the rigid containment means for rapidly clamping the rigid containment means between the floor and the ceiling within the interior of the building, means carried by the rigid containment means for providing a "rough" height adjustment of the rigid containment means between the floor and the ceiling, and a means carried by the rigid containment means for "fine" height adjustment after the "rough" height adjustment has been made, and prior to actuating the clamping means.

32. The pollution abatement apparatus of claim 31, wherein the rigid containment member is made from Lexan™.

33. A pollution abatement apparatus for removing a polluted structure located on a wall of a building, the building including an interior having a floor and a ceiling, respectively, the apparatus comprising:

a rigid containment means adapted to fit against the polluted structure within the interior of the building and to surround the polluted structure in a substantially air-tight relationship, thereby precluding a pollutant from polluting the interior of the building as the polluted structure is removed, a clamping means carried by the rigid containment means for rapidly clamping the rigid containment means between the floor and the ceiling within the interior of the building, means carried by the rigid containment means for providing a "rough" height adjustment of the rigid containment means between the floor and the ceiling, and a means carried by the rigid containment means for "fine" height adjustment after the "rough" height adjustment has been made, and prior to actuating the clamping means, wherein the rigid containment means includes a single unitary member having a bottom, walls extending from the bottom and continually surrounding the bottom of the single unitary member, a ledge for leaning against the wall of the building and surrounding the polluted structure, and three bars crossing the bottom of the single unitary member in spaced apart arrangement and extending substantially a whole width of the single unitary member.

34. The pollution abatement apparatus of claim 33, wherein the single unitary member is a plastic molded transparent unit.

35. The pollution abatement apparatus of claim 33, wherein the means for "rough" height adjustment includes at least one supporting member, along which the single unitary member reciprocally slides, wherein the supporting member comprises:

a tubular body, a top edge pad for leaning against the ceiling, and a bottom edge pad for leaning against the floor, and wherein at least one fastening means is removably secured to each of said bar for removably securing said at least one supporting member to the single unitary member.

36. The pollution abatement apparatus of claim 35, including a pair of spaced apart substantially parallel said supporting members, each being secured to respective edges of said three bars.

37. The pollution abatement apparatus of claim 35, wherein the supporting member is secured substantially to centers of said three bars.

38. The pollution abatement apparatus of claim 35, wherein the supporting member is secured diagonally to said single unitary member.

39. The pollution abatement apparatus of claim 35, wherein said fastening means are regulated from loosen to immovable by a weld nut, thereby allowing the "rough" height adjustment of the single unitary member.

40. The pollution abatement apparatus of claim 35, wherein the supporting member has a telescoping top member, which is adjustably extended a certain length from a top end of the tubular body of the supporting member, thereby allowing a "fine" height adjustment for the single unitary member.

41. The pollution abatement apparatus of claim 40, wherein the clamping means includes a ratchet mechanism, having:

a ratchet bar secured to the telescopic top member of the supporting member, and a pawl for arresting the motion of the top telescopic member.

42. The pollution abatement apparatus of claim 41, wherein each pawl is associated with a handle for actuating the pawl to arrest the motion of the top telescopic member and for releasing the top telescopic member when further height adjustment is needed.

43. The pollution abatement apparatus of claim 42, wherein the handle serves for lifting the single unitary member and positioning the single unitary member against the polluted structure.

44. The pollution abatement apparatus of claim 43, wherein the ratchet mechanism is provided with a lock securing the handle in "arresting" position.

45. The pollution abatement apparatus of claim 35, wherein the supporting member has a telescopic bottom member, which, being extended a certain length from a lower end of the tubular body of the supporting member, allows additional height adjustment for the single unitary member.

* * * * *